US007400851B2

(12) United States Patent
Kuma et al.

(10) Patent No.: US 7,400,851 B2
(45) Date of Patent: Jul. 15, 2008

(54) IMAGE FORMING APPARATUS WITH PRESSURE APPLYING MEMBERS THAT APPLY PRESSURE TO SUPPORT SHAFTS

(75) Inventors: Kazuosa Kuma, Kanagawa (JP); Yusuke Noguchi, Kanagawa (JP); Makoto Kikura, Kanagawa (JP); Hiroshi Ishii, Kanagawa (JP); Kazuki Suzuki, Saitama (JP); Yutaka Fukuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 295 days.

(21) Appl. No.: 11/150,105

(22) Filed: Jun. 13, 2005

(65) Prior Publication Data

US 2005/0281594 A1 Dec. 22, 2005

(30) Foreign Application Priority Data

Jun. 18, 2004 (JP) ..... 2004-181414

(51) Int. Cl.
*G03G 15/01* (2006.01)

(52) U.S. Cl. ..... 399/299; 399/302

(58) Field of Classification Search ..... 399/299, 399/302, 126

See application file for complete search history.

(56) References Cited

U.S. PATENT DOCUMENTS

| | | | | |
|---|---|---|---|---|
| 5,052,336 | A | 10/1991 | Fukuchi | |
| 5,329,340 | A | 7/1994 | Fukuchi et al. | |
| 5,689,764 | A | 11/1997 | Fukuchi et al. | |
| 5,913,095 | A | 6/1999 | Takashima et al. | |
| 6,128,451 | A | 10/2000 | Fukuchi | |
| 6,385,418 | B1 | 5/2002 | Fukuchi | |
| 6,571,073 | B1 | 5/2003 | Suzuki et al. | |
| 6,898,407 | B2 | 5/2005 | Noguchi et al. | |
| 7,076,189 | B2 * | 7/2006 | Yoshino | 399/302 |
| 2003/0091373 | A1 * | 5/2003 | Abe et al. | 399/302 |
| 2004/0131380 | A1 | 7/2004 | Kuma et al. | |
| 2004/0208676 | A1 | 10/2004 | Ishii et al. | |
| 2004/0223790 | A1 | 11/2004 | Hosokawa et al. | |
| 2005/0008393 | A1 | 1/2005 | Kuma et al. | |
| 2005/0084293 | A1 | 4/2005 | Fukuchi et al. | |
| 2005/0281594 | A1 | 12/2005 | Kuma et al. | |

FOREIGN PATENT DOCUMENTS

| | | |
|---|---|---|
| JP | 11-344905 | 12/1999 |
| JP | 2001-209227 | 8/2001 |
| JP | 2002-139976 | 5/2002 |

OTHER PUBLICATIONS

U.S. Appl. No. 11/518,898, filed Sep. 12, 2006, Yamada et al.

* cited by examiner

*Primary Examiner*—Susan S Lee
(74) *Attorney, Agent, or Firm*—Oblon, Spivak, McClelland, Maier & Neustadt, P.C.

(57) ABSTRACT

An image forming apparatus that has improved usability, while maintaining good positional relationship of units detachably installed inside the apparatus body. The image forming apparatus includes a plurality of rotatable image carriers, each incorporated in a respective image producing unit, and an intermediate transfer unit including an intermediate transfer body which is installed between a plurality of roller members and to which transfer toner images formed on each image carrier are transferred. The shaft of each image carrier and the shaft of each roller are disposed on a positioning plate, and each image carrier and the intermediate transfer body are fixed in normal positions by applying pressure independently to each shaft.

54 Claims, 14 Drawing Sheets

IMAGE FORMING APPARATUS WITH PRESSURE APPLYING MEMBERS THAT APPLY PRESSURE TO SUPPORT SHAFTS

BACKGROUND OF THE INVENTION

1. Field of the Invention

The present invention relates to an image forming apparatus such as a color printer, a color copier, a color facsimile, or a complex apparatus of these printer, copier and facsimile.

2. Description of the Related Art

Electrophotographic image forming apparatuses for forming color images on a recording material such as paper or film are known. In color image forming apparatuses, color images are generally formed by using toners of four colors as developers. As a result the number of structural components is larger and the size can be easily increased over those of the monochromatic image forming apparatuses. Moreover, the number of units produced within a unit time, that is, the speed during color printing, is reduced. Following the spread of personal computers, the number of cases where the image forming apparatuses are used as the so-called printers in connection with personal computers has increased, personalization of the image forming apparatuses has advanced, and in most cases they are conveniently disposed close to the product user. Therefore, with consideration for user's operability, the image forming apparatus is desired to have a small height, and a small, e.g., narrow, apparatus is preferred based on space considerations. Furthermore, to provide for personalization and maintenance cost reduction of the image forming apparatuses, the users themselves conduct maintenance or replacement of spent components of the apparatuses.

From the standpoint of increasing the printing speed in color image forming apparatuses, tandem-type image forming apparatuses in which a plurality of developing image units are disposed in close proximity to a plurality of photosensitive bodies disposed in a row, a monochromatic toner image is formed on each photosensitive body, and the toner images are successively transferred, thereby transferring a color image onto a recording material, have an advantage over the well-known single-drum system in which developing units of a plurality of colors are provided around one image transfer body and the photosensitive body is rotated by the developing units to transfer toner images developed with developing units, synthesize a color image on the photosensitive body, and transfer this image onto a recording material.

When such a tandem-type image forming apparatus is wished to be reduced in size, the length of the apparatus in the arrangement direction can be reduced by disposing the image-producing units, in which a photosensitive body and a developing unit are integrated, or an intermediate transfer unit at an angle, as described in Japanese Patent Application Laid-open No. 2002-139976, rather than horizontally inside the apparatus body. Furthermore, the apparatus is so configured that each unit can be detachably attached to the apparatus body through an opening provided in the apparatus body and can be replaced or maintained when necessary. When the image forming apparatus has such a plurality of units that are detachably attached to the apparatus body, the image shift occurs if the position of the units during attachment is not established. For this reason, as described in Japanese Patent Application Laid-open No. 2002-139976, one end of each unit is supported inside the apparatus body and the other end is supported with a holding unit provided so that it can be opened and closed on the apparatus body.

In image forming apparatuses employing an electrophotographic process, power supply is conducted from a high-voltage power supply unit provided inside the apparatus body to the members requiring power supply, such as charging rollers, developing rollers, and cleaning rollers provided in image producing units, or intermediate transfer rollers, intermediate transfer cleaning rollers, and secondary transfer rollers provided in the intermediate transfer unit.

In the apparatus described in Japanese Patent Application Laid-open No. 2002-139976, when the image producing units or intermediate transfer unit are pulled out from the apparatus body, the operations are difficult because the holing unit cannot be opened or closed unless the screws fixing the holding unit to the apparatus body are removed with a tool. The holding unit requires accurate positioning with respect to the apparatus body since it is responsible for positioning each unit in a closed state thereof. Furthermore, because the holding unit can be opened and closed with respect to the apparatus body, a clearance is provided between the holding unit and the units located inside the apparatus body to ensure smooth operations when the units located inside the apparatus body are positioned. For this reason, there is a certain looseness even when the holding unit assumes a closed position. Therefore, the relative position of the photosensitive body and image producing units differs, even if very little, from the expected one, thereby creating a risk of image transfer position shifting at the time color superposition transfer conducted during multicolor image formation. Such a shift in image transfer results in the appearance of defective images such as color shift. Furthermore, each component of the holding unit has to be strong because this unit supports the image producing units and intermediate transfer unit. As a result, the weight thereof rises when the rigidity is increased by using a metal plate or the like. For this reason, each component relating to opening and closing the holding unit is required to have a higher strength. Moreover, safety has to be provided in the opening and closing direction because the apparatus might be inadvertently toppled when the holding unit is released.

SUMMARY OF THE INVENTION

It is an object of the present invention to provide an image forming apparatus in which usability is improved, while maintaining good mutual arrangement of the units detachably attached inside the apparatus body.

An image forming apparatus of the present invention comprises a plurality of rotatable image carriers, each incorporated in a respective image producing unit; an intermediate transfer unit comprising an intermediate transfer body which is installed between a plurality of roller members and to which transfer toner images formed on each image carrier are transferred; and positioning mechanisms for disposing the shaft of each image carrier and the shaft of each roller on a positioning plate and fixing the each image carrier and the intermediate transfer body in normal positions by applying pressure independently to each shaft.

An image forming apparatus of the present invention comprises a plurality of rotatable image carriers, each incorporated in a respective image producing unit; an intermediate transfer unit comprising an intermediate transfer body which is installed between a plurality of roller members and to which transfer toner images formed on each image carrier are transferred; and an opening and closing face plate comprising a positioning plate for supporting one end of the shaft of each image carrier and the shaft of each roller and positioning mechanisms for fixing the each image carrier and intermediate transfer body in normal positions by applying pressure independently to each shaft, in the vicinity of replacement ports formed in the image forming apparatus body, which has detachably attached thereto the image producing units and the intermediate transfer unit, and used to attach and detach the units. The opening and closing face plate is attached so as to open and close said replacement ports.

An image forming apparatus of the present invention comprises a plurality of rotatable image carriers, each incorporated in a respective image producing unit; an intermediate transfer unit comprising an intermediate transfer body which is installed between a plurality of roller members and to which transfer toner images formed on each image carrier are transferred; and a casing comprising a positioning plate for respectively supporting the other end side of the shaft of each image carrier and the shaft of each roller on the drive force connection side of each image producing unit and the intermediate transfer unit and positioning mechanisms for fixing the each image carrier and the intermediate transfer body in normal positions by applying pressure independently to the shafts supported in the positioning plate.

An image forming apparatus of the present invention comprises a plurality of rotatable image carriers, each incorporated in a respective image producing unit; an intermediate transfer unit comprising an intermediate transfer body which is installed between a plurality of roller members and to which transfer toner images formed on each image carrier are transferred; and a casing comprising bearing members for respectively supporting the other end side of the shaft of each image carrier and the shaft of each roller on the drive force connection side of the each image producing unit and the intermediate transfer unit and positioning mechanisms for fixing the each image carrier and the intermediate transfer body in normal positions by applying pressure independently to the shafts supported by each bearing member.

An image forming apparatus of the present invention comprises a plurality of rotatable image carriers, each incorporated in a respective image producing unit; an intermediate transfer unit comprising an intermediate transfer body which is installed between a plurality of roller members and to which transfer toner images formed on each image carrier are transferred; and an opening and closing face plate comprising a positioning plate having therein bearing members for supporting one end of the shaft of each image carrier and the shaft of each roller, positioning mechanisms for fixing the each image carrier and intermediate transfer body in normal positions by applying pressure from above, independently to each shaft, and pressure release mechanisms for releasing pressure applied to each shaft by said positioning mechanisms by movement operation of a slide plate movably attached to the positioning plate, below replacement ports formed in the image forming apparatus body, which has detachably attached thereto the image producing units and the intermediate transfer unit, and used to attach and detach the units. The opening and closing face plate is attached so as to open and close the replacement ports.

An image forming apparatus of the present invention comprises a plurality of rotatable image carriers, each incorporated in a respective image producing unit; an intermediate transfer unit comprising an intermediate transfer body which is installed between a plurality of roller members and to which transfer toner images formed on each image carrier are transferred; and an opening and closing face plate comprising positioning mechanisms provided on a positioning plate, which has provided therein V-shaped orifices for supporting one end of the shaft of each image carriers and the shaft of each roller, and serving to fix the image carriers and intermediate transfer body in normal positions by applying pressure independently to each shaft with a torsion coil spring, and mechanisms movably provided on the positioning plate for releasing the pressure applied to each shaft by moving a movable slide plate by a lever operation. The opening and closing face plate is attached in the vicinity of replacement ports formed in the image forming apparatus body, which has detachably attached thereto the image producing units and the intermediate transfer unit, and used to attach and detach the units, so as to open and close the replacement ports.

An image forming apparatus according to one example of the present invention includes a plurality of rotatable image carriers, each incorporated in a respective image producing unit; an intermediate transfer unit comprising an intermediate transfer body which is installed between a plurality of roller members and to which transfer toner images formed on each image carrier are transferred; and an opening and closing face plate comprising positioning mechanisms comprising pressure members for elastically applying pressure independently to the shaft of each image carrier and the shaft of each roller on a positioning plate, which has provided therein V-shaped bearings for supporting one end of the shaft of each image carriers and the shaft of each roller, and serving to fix the image carriers and intermediate transfer body in normal positions, and mechanisms movably provided on the positioning plate for releasing the pressure applied to each shaft by moving a movable slide plate by a lever operation. The opening and closing face plate is attached in the vicinity of replacement ports formed in the image forming apparatus body, which has detachably attached thereto the image producing units and the intermediate transfer unit, and used to attach and detach the units, so as to open and close the replacement ports.

An image forming apparatus of the present invention comprises a plurality of rotatable image carriers, each incorporated in a respective image producing unit; an intermediate transfer unit comprising an intermediate transfer body which is installed between a plurality of roller members and to which transfer toner images formed on each image carrier are transferred; and an opening and closing face plate comprising a mechanism having members for applying pressure to the shaft of each image carrier and the shaft of each roller, those members being integrally provided on a slide plate movably provided on a positioning plate, which has provided therein V-shaped bearings for supporting one end of the shaft of each image carrier and the shaft of each roller, and serving to fix the image carriers and intermediate transfer body in normal positions by this applied pressure and to release the pressure applied to each shaft by moving the slide plate by a lever operation. The opening and closing face plate is attached in the vicinity of replacement ports formed in the image forming apparatus body, which has detachably attached thereto the image producing units and the intermediate transfer unit, and used to attach and detach the units, so as to open and close the replacement ports.

An image forming apparatus of the present invention comprises a plurality of rotatable image carriers, each incorporated in a respective image producing unit, an intermediate transfer unit comprising an intermediate transfer body which is installed between a plurality of roller members and to which transfer toner images formed on each image carrier are transferred; and an opening and closing face plate comprising a mechanism having members for applying pressure to the shaft of each image carrier and the shaft of each roller, those members being integrally provided on a positioning plate, which has provided therein V-shaped bearings for supporting one end of the shaft of each image carrier and the shaft of each roller, and serving to fix the image carriers and intermediate transfer body in normal positions by this applied pressure and to release the pressure applied to each shaft by moving a slide plate, which is movably provided on said positioning plate, by a lever operation. The opening and closing face plate is attached in the vicinity of replacement ports formed in the image forming apparatus body, which has detachably attached thereto the image producing units and the intermediate transfer unit, and used to attach and detach the units, so as to open and close the replacement ports.

An image forming apparatus of the present invention comprises a plurality of rotatable image carriers, each incorporated in a respective image producing unit; an intermediate transfer unit comprising an intermediate transfer body which is installed between a plurality of roller members and to which transfer toner images formed on each image carrier are transferred; and an opening and closing face plate comprising a mechanism having members for applying pressure to the shaft of each image carrier and the shaft of each roller, those members being integrally provided on bearing members installed on a positioning plate for supporting one end of the shaft of each image carrier and the shaft of each roller, and serving to fix the image carriers and intermediate transfer body in normal positions by this applied pressure and to release the pressure applied to each shaft by moving a slide plate, which is movably provided on the positioning plate, by a lever operation. The opening and closing face plate is attached in the vicinity of replacement ports formed in the image forming apparatus body, which has detachably attached thereto the image producing units and the intermediate transfer unit, and used to attach and detach the units, so as to open and close the rikoreplacement ports.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

The image forming apparatus employing the present invention will be explained below with reference to the appended drawings. In the below-described embodiment, an image forming apparatus of an electrophotographic system capable of forming full-color images will be explained by means of an example.

Figure 1:
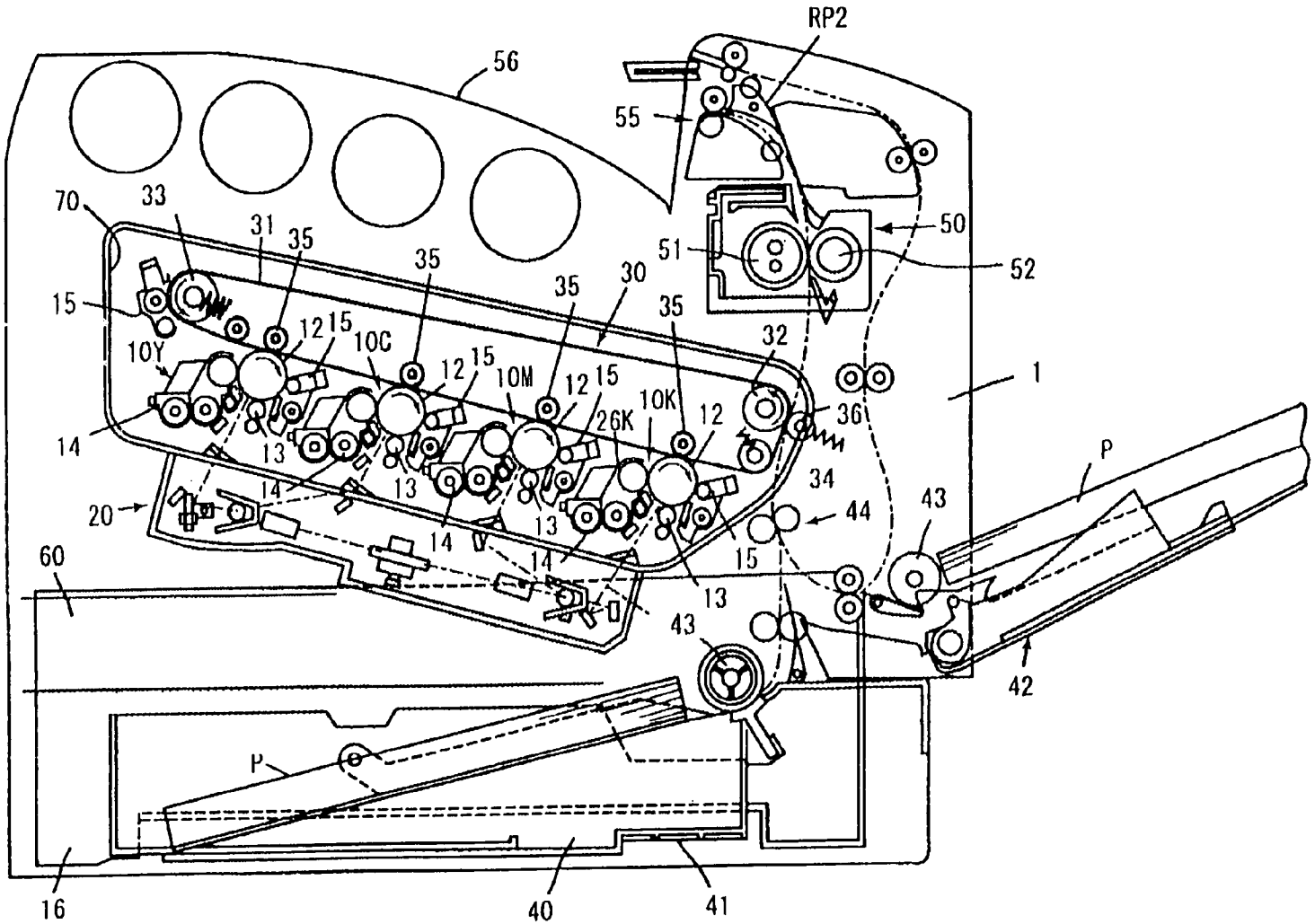
FIG. 1 is a cross-sectional view illustrating the schematic configuration of the image forming apparatus employing the present invention.

FIG. 1 shows a schematic configuration of the image forming apparatus of this embodiment. In the image forming apparatus shown in the figure, four-color image producing units 10Y (yellow), 10C (cyan), 10M (magenta), 10K (black), which serve as image carrier units, are detachably attached to corresponding image forming stations, and the apparatus comprises an optical unit 20 as exposure means capable of illuminating with a laser beam, an intermediate transfer body unit 30, a paper feed unit 40, and a fixing unit so.

The image producing units 10Y, 10C, 10M, 10K have the same structure, each integrally comprising a photosensitive drum 12 as an image carrier, a charging unit 13 for charging the photosensitive drum and serving as process means acting upon the photosensitive drum, and a cleaning unit 14 for removing a developing agent etc. that remained on the photosensitive drum, those image producing units having linked thereto a developing unit 15 for developing the latent images formed on the photosensitive drums serving as image carriers. Each image producing unit is so configured that it can be attached and detached in the rotary shaft direction of each photosensitive drum through openings 70 for attaching and detaching, which serve as unit replacement ports formed on the front side of the image forming apparatus body 1 serving as a casing.

The intermediate transfer body unit 30 comprises a transfer belt 31 as an intermediate transfer body, a plurality (here, three) rollers 32, 33, 34 for rotatably supporting the transfer belt 31, a primary transfer roller 35 for transferring toner images formed on each photosensitive drum 12 onto the transfer belt 31, and a secondary transfer roller 36 for further transferring the toner image transferred to the transfer belt 31 to recording paper P. The intermediate transfer body unit 30 also has a configuration allowing it to be attached and detached through the opening 70.

The paper feed unit 40 comprises a paper feed roller 43 for transporting the recording paper P from a paper feed cassette 41 or a manual paper feed tray 42 to the secondary transfer region and a resist roller 44. The fixing unit 50 comprises a fixing roller 51 and a pressure roller 52 and has a well-known configuration for conducting fixing by heat and pressure application to the toner image present on the recording paper P.

With the above-described configuration, first, a photosensitive drum 12 is uniformly charged with the electrification unit 13 in the yellow (first color) image producing unit 10Y, and then a toner image is formed by developing the latent image by the developing unit 14 with a laser beam emitted from the optical unit 20.

The toner image formed on the photosensitive drum 12 is transferred to the transfer belt 31 by the action of the primary transfer roller 35. The photosensitive drum 12 from which primary transfer has been completed is cleaned with the cleaning unit 15 and provided for the next cycle of image formation. The remaining toner recovered with the cleaning unit 15 is stored in a spent toner recovery bottle 16 disposed in the removal direction (rotary shaft direction of the photosensitive drum) of the image producing unit 10Y. The spent toner recovery bottle 16 is detachably mounted on the image forming apparatus body 1 so that it can be replaced when filled with the spent toner. Identical image forming processes are also carried out in the image producing units 10C, 10M, 10K for C, M, and K, respectively, and toner images of each color are produced and successively transferred in superposition on the previously formed toner image.

Oh the other hand, the toner image formed on the transfer belt 31 is transferred by the action of the secondary transfer roller 36 to the recording paper P transported to the secondary transfer region from the paper feed cassette 41 or manual paper feed tray 42. The recording paper P onto which the toner image has been transferred is transferred to the fixing unit 50, the toner image is fixed in the nip section of the fixing roller 51 and pressure roller 52 of the fixing unit 50, and the paper is delivered to the delivered paper tray 56 with a delivery roller 55.

The configuration of the open-close surface plate 100, which is a feature component of the present embodiment, will be described below with reference to FIGS. 2 to 4.

Figure 2:
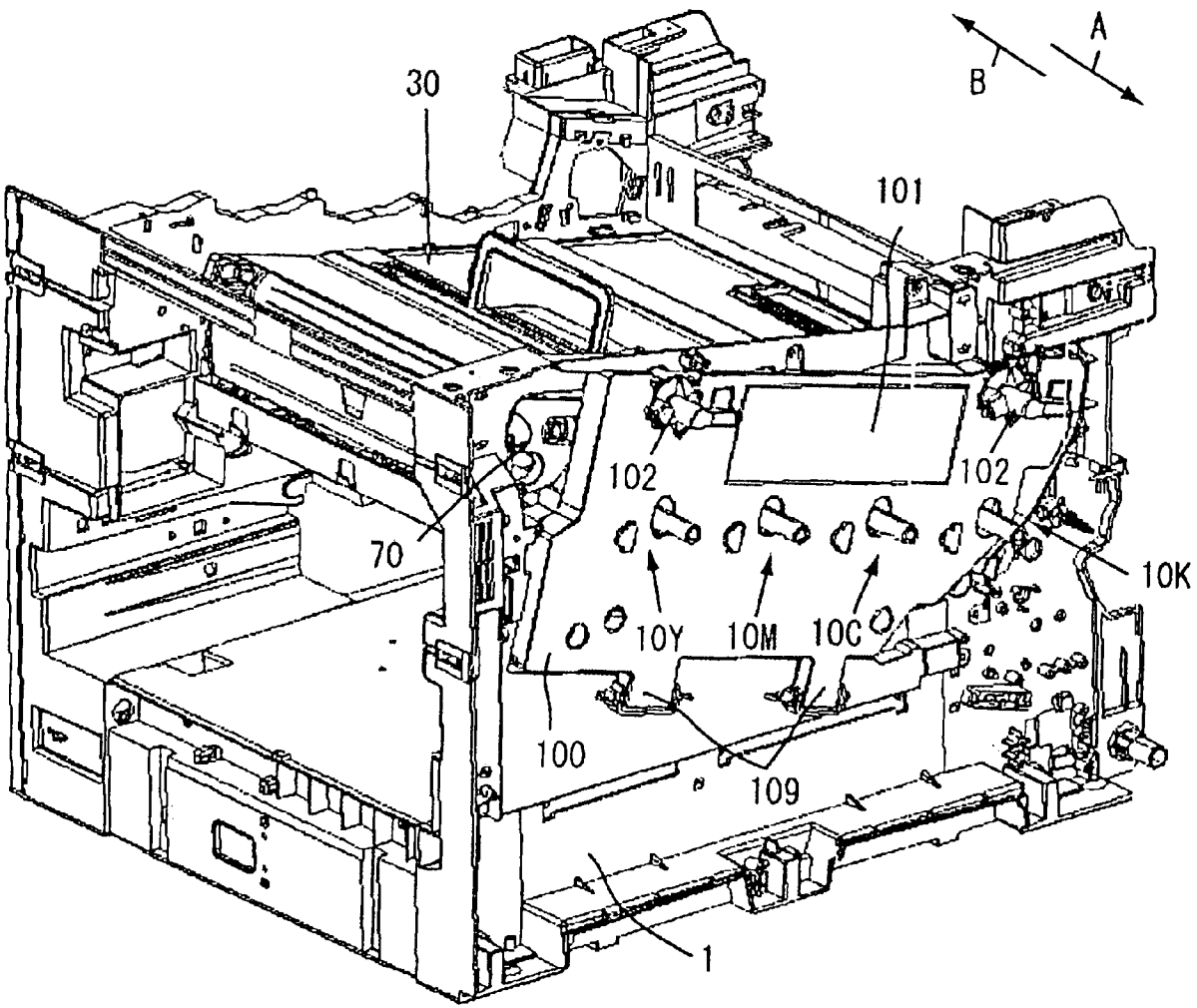
FIG. 2 is a perspective view illustrating the state in which the casing and the opening and closing face plate of the image forming apparatus illustrated in FIG. 1 are installed.
Figure 3:
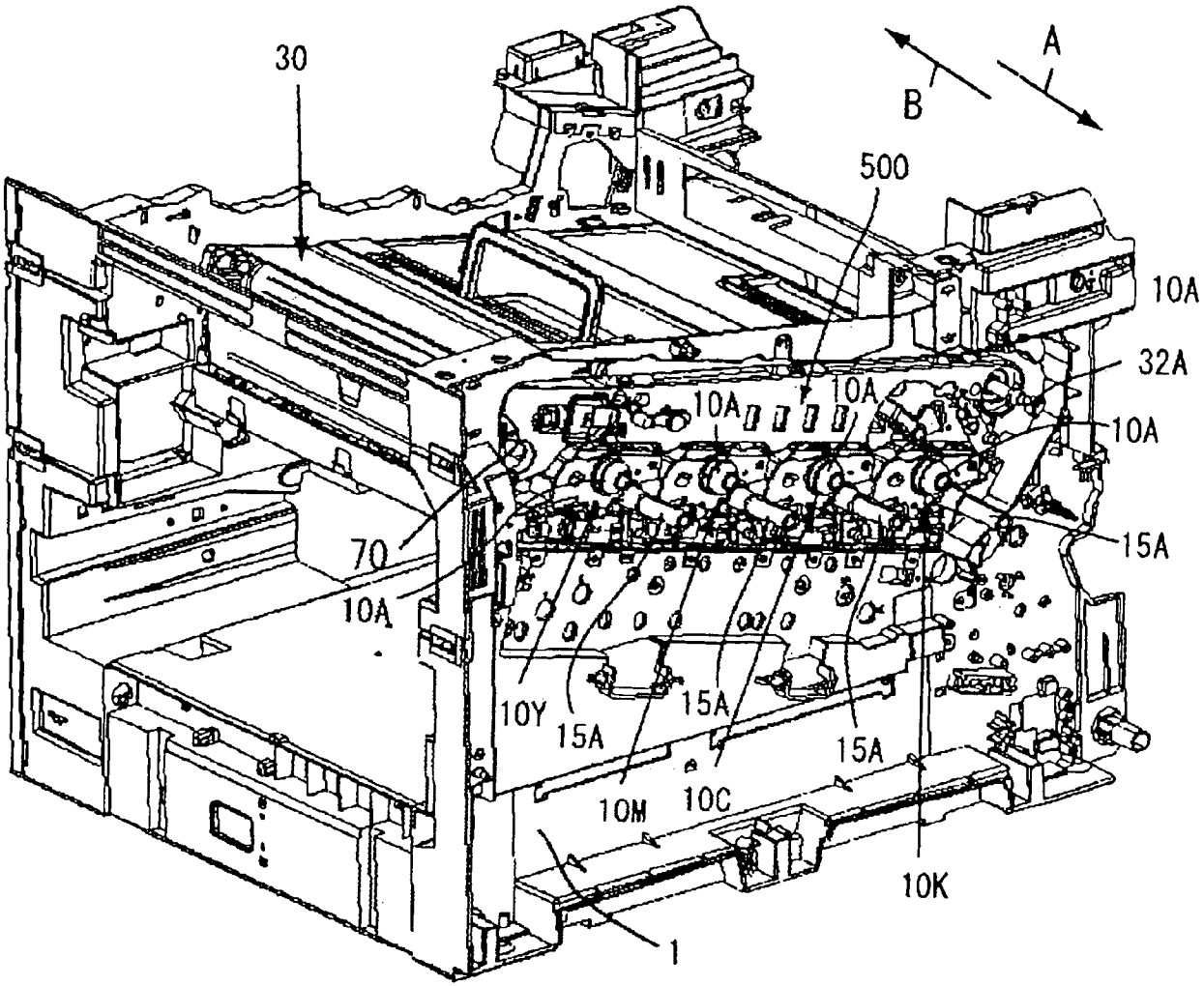
FIG. 3 is an enlarged view illustrating the relative positions of the opening and closing face plate and each shaft.

As shown in FIGS. 2 and 3, the opening and closing face plate 100 serves to guide and fix in the prescribed position the photosensitive drums 12 incorporated in image producing units 10Y, 10C, 10M, 10K and rollers 32, 33, 34 having stretched over them the intermediate transfer belt 31 comprised in the intermediate transfer body unit 30. The opening and closing face plate 100 is supported, so that it is free to swing, below the opening 70 of the image forming apparatus body 1 so that it can assume a position in which it covers or a position in which it opens the opening 70 of the image forming apparatus body 1 shown in FIG. 1. In FIGS. 2 and 3, the arrow A shows the detachment direction and the arrow B shows the attachment direction. Each photosensitive drum 12 is inclined downward and to the right at an angle of about 15 degrees with respect to the image forming apparatus body 1 and grounded, and the opening and closing face plate 100 is attached to the image forming apparatus body 1 with an inclination of about 15 degrees in the same direction in the opposing position. Thus, the opening and closing face plate 100 can be closed and opened with the same inclination as that of the opening in the vicinity of the opening 70, thereby making it possible to open widely the opening 70 in the image forming apparatus body 1 and improving replaceability and usability.

Figure 4:
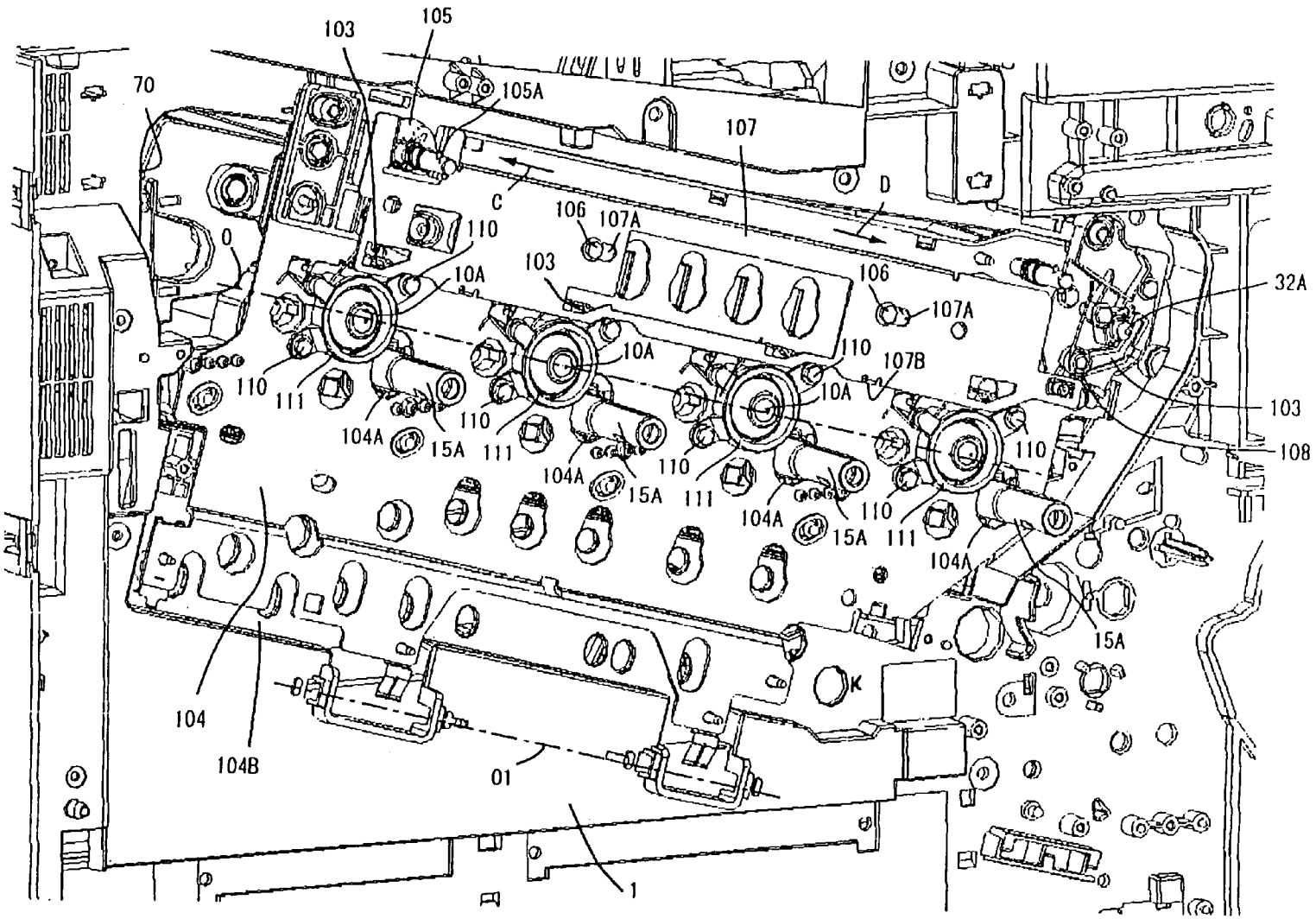
FIG. 4 is a perspective view illustrating the state after the outer cover of the opening and closing face plate has been removed.

FIG. 2 shows the closed position in which the opening and closing face plate 100 closes the opening 70, and FIG. 3 and FIG. 4 show the internal structure and state of the opening and closing face plate 100. In the present embodiment, the opening and closing face plate 100 supported so that it can be opened and closed with a pair of hinges 109 supports and aligns one end of a shaft 32A of the roller 32, a shaft 10A of each photosensitive drum 12, and a developing agent recovery shaft 15A provided in each cleaning unit 15 and transporting the recovered toner to the spent toner recovery bottle 16.

Referring to FIG. 2, the reference numeral 101 stands for an outer cover of the opening and closing face plate 100, and reference numerals 102A, 102B stand for lock levers for fixing the opening and closing face plate 100 in the closed position. As shown in FIG. 4, the lock levers 102A, 102B are mounted on respective shafts 105A of cams 105 provided on the opening and closing face plate 100 and can rotationally operate the cams 105. The cam 105 of the lock lever 102B is not shown in the figure. The cam 105 of the lock lever 102A is engaged with part of a slide plate 107 made from a plate metal and provided so that it can move in the left-right direction shown by arrows C, D in FIG. 4 with respect to a positioning plate 104 made of a plate metal and constituting part of the opening and closing face plate 100.

A plurality of long holes 107A for inserting a plurality of stepped screws 106 provided in the positioning plate 104 are formed in the slide plate 107 so as to extend in the direction of arrows C, D. The slide plate 107 is disposed above the positioning plate 104 with an inclination such that central line O connecting the shafts 10A of photosensitive drums and the rotation center line O1 positioned on the side of the lower section 107B thereof become parallel to each other. As a result, when the cam 105 rotates, the slide plate 107 moves in the direction of arrows C, D on the positioning plate 104 correspondingly to the rotation direction.

A bearing orifice 104A for inserting and supporting the developing agent recovery shaft 15A and a V-shaped bearing 111 serving as a bearing member for supporting one end of the shaft 32A of the roller 32 and shaft 10A of each photosensitive drum are provided in the positioning plate 104. The other ends of the developing agent recovery shaft 15A, shaft 10A, and shaft 32A are rotatably supported by the bearing members and bearing orifices formed in the side plate made of a plate metal, which is disposed inside the image forming apparatus body 1. This bearing orifice is formed to have the same shape as the bearing orifice 104A. As a result, they can be manufactured by using the same punching die and the productivity is increased. Furthermore, because the production margins of the orifices are unified, the component assembly error can be reduced. Forming the bearing orifice 104A integrally with the positioning plate 104 makes it possible to decrease the number of parts and reduce cost by comparison with the case where the end portion of the shaft 10A is supported with a bearing member.

Producing the positioning plate 104 and slide plate 107 from metals ensures a high strength of each plate, allows them to be used as grounding members of each photosensitive drum and intermediate transfer belt 31, and makes it possible to reduce the number of components. If the positioning plate 104 is from a metal and obtained by die casting, rather than from a plate metal, the same shape can be obtained for all the sections, the plate can function as a grounding member, while maintaining a high strength, and the number of components can be reduced. Alternatively, if the positioning plate 104 is a resin molding, the same shape can be obtained for all the sections at a low cost and the leak of bias such as electrostatic charge can be prevented.

Figure 6:
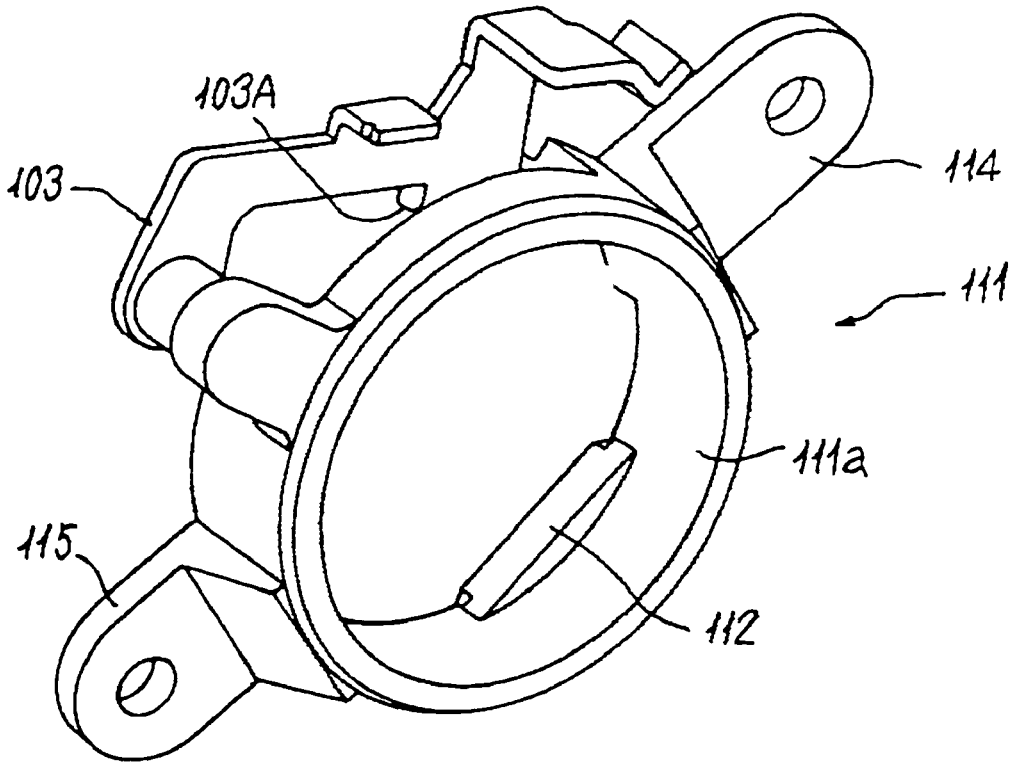
FIG. 6 is a perspective view illustrating a configuration example and installation example of the bearing member and arm member.

Positioning mechanisms 500 for positioning the shaft 10A of each photosensitive drum and the shaft 32A of the roller 32 by applying pressure independently to each shaft are provided on the opening and closing face plate 100. Each positioning mechanism 500 is configured to move in response to the movement of the slide plate 107. The positioning mechanism comprises a V-shaped bearing 111 provided at the positioning plate 104, a metallic arm member 103 for applying pressure to the shaft 10A of each photosensitive drum and the shaft 32A of the roller 32 toward the respective shaft center, and a torsion coil spring 108 which is impelling means serving as pressure application means for applying pressure to each shaft 10A and shaft 32A by applying an impelling force to the arm member 103. As shown in FIG. 6, the arm member 103 is rotatably supported by the V-shaped bearing 111. In other words, the arm member 103 has a rotation fulcrum thereof on the V-shape bearing 111. The surface 103A of the arm member 103 that abuts against the shaft is a plane. The arm members 103 are configured to apply pressure from above to the shafts 10A, 32A supported by the V-shaped bearings 111. If the material of the arm members 103 is a metal, they can be electrically conductive. Therefore, when grounding has to be conducted, for example, for the photosensitive drum 12, the arm members can function as grounding members. If the arm members 103 are made from a synthetic resin, they can provide for insulation when it is necessary to prevent the charged members, such as the intermediate transfer belt and photosensitive drum, from being grounded.

Figure 5:
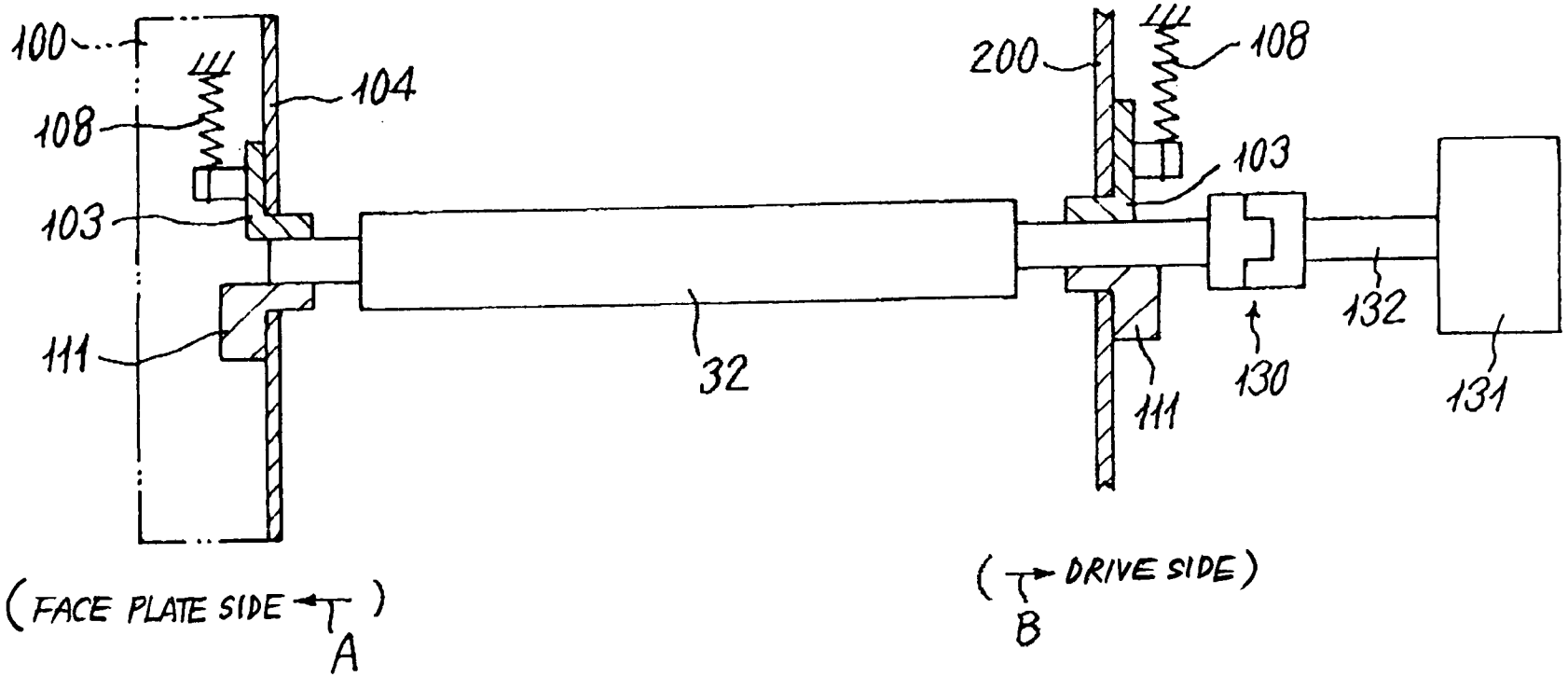
FIG. 5 illustrates an example of the shaft supported by the opening and closing face plate and the casing.

In the present embodiment, the positioning mechanism is attached to the opening and closing face plate 100, but the arm members 103, V-shaped bearings 111, and torsion coil springs 108 may be provided on the side plate 200 fixed to the image forming apparatus body 1, functioning as a positioning plate and opposing the positioning plate 104 when it assumes a closed position, as shown in FIG. 5. Referring to FIG. 5, a drive shaft 132 of a drive motor 131 is connected via a coupling 130 to the other end side of the shaft 10A of the photosensitive drum 12. Thus, the positioning mechanisms may be also installed on the drive force connection side of each image producing unit 10Y, 10M, 10C, 10K and the intermediate transfer unit 30, and providing the positioning mechanism on the drive side serving as the drive force connection side makes is possible to inhibit oscillations of the shaft 10A of each photosensitive drum 12 and the shaft 32A of the roller 32 caused by the drive force. FIG. 5 illustrates an example of the roller 32, but the shafts 10A of photosensitive drums may be also driven independently, as shown in FIG. 5.

Figure 7:
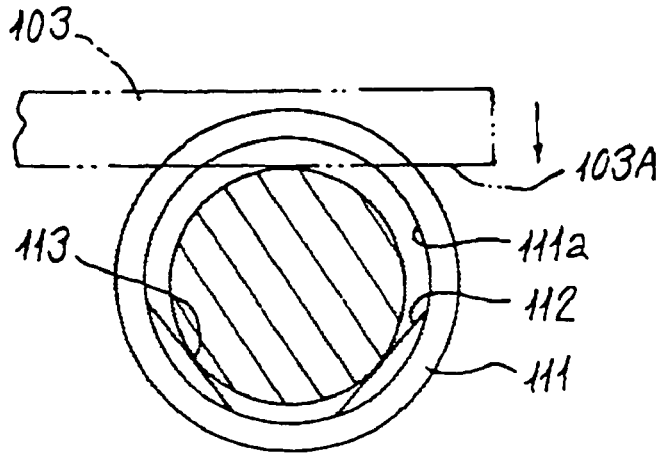
FIG. 7 is an enlarged cross-sectional view illustrating an example of the state in which a shaft is held by the bearing member and arm member.

As for the V-shaped bearing 111, which is a bearing member, as shown in FIG. 6 and FIG. 7, inclined surfaces 112, 113 are formed so as to obtain a V-like shape or a shape similar thereto in the inner part 11*a* serving as a shaft orifice thereof.

If the V-shaped bearing 111 is thus provided in the opening and closing face plate 100 that opens and closes the opening 70 of the image forming apparatus body from below, then when the opening and closing face plate 100 is closed, the shafts 10A, 32A can be easily taken up from below. When the shaft orifice of the bearing is a perfect circle, gap fitting has to be employed if the removal of the shaft is taken into account. However, when the inclined surfaces 113, 114 are formed so as to obtain a V-like shape or a shape similar thereto, as in the present embodiment, and a method of pressure application from above with the arm members 103 is employed, then the shafts 10A, 32A can be held in the center on the layout and the fixing accuracy can be increased.

Because pressure is independently applied to each shaft 10A, 32A from above by the arm members 103, each shaft 10A, 32A is squeezed in the vertical direction, held, and fixed by the inclined surfaces 112, 113 and arm member 103. Therefore, fixing accuracy can be increased. Furthermore, because the surface 103A of the arm members 104 that apply pressure to each shaft 10A, 32A, this surface abutting against the shafts, is a plane, a wide abutment region can be ensured and pressure can be reliably applied to each shaft.

Figure 8:
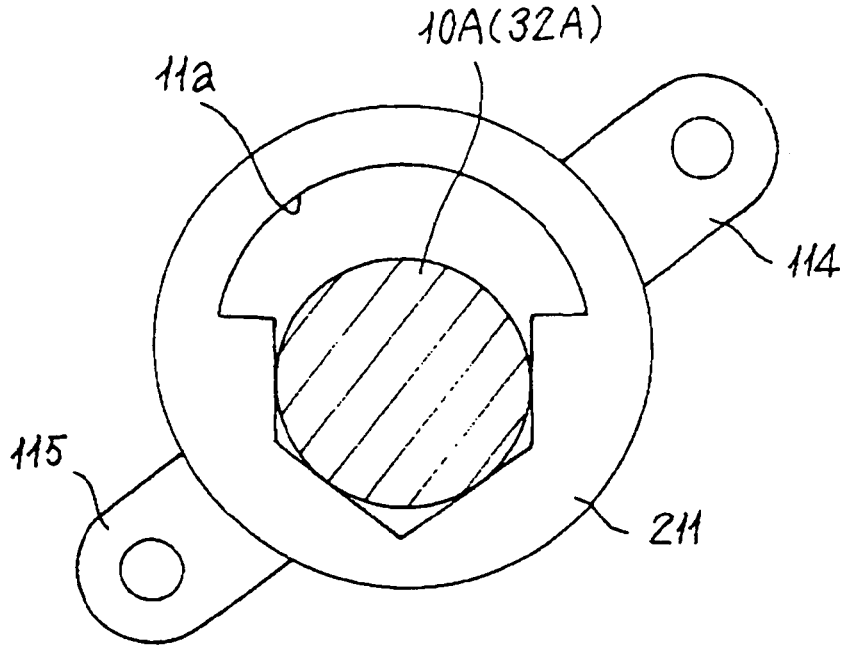
FIG. 8 is an enlarged view illustrating another embodiment of the bearing member.
Figure 9:
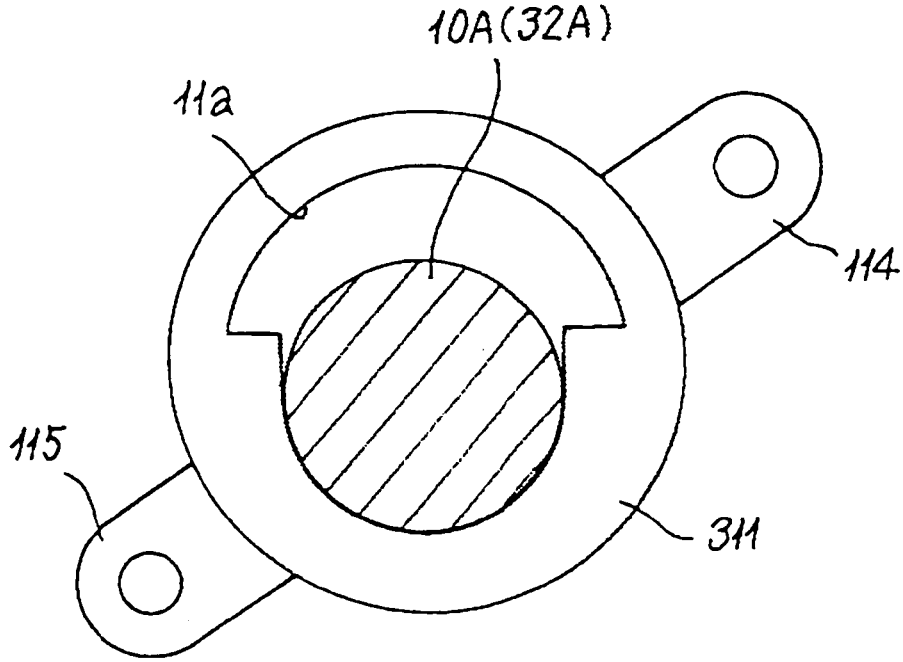
FIG. 9 is an enlarged view illustrating another embodiment of the bearing member.

In FIG. 6 and FIG. 7, the V-shaped bearing 111 having the inclined surfaces 112, 113 formed on the inner portion 111*a* is shown as an example of the bearing member, but the bearing member is not limited to this embodiment. For example, it may be a bearing member 211 in which the inner portion 211*a* serving as a shaft orifice is formed to have a polygonal shape, as shown in FIG. 8, or it may be a bearing member 311 in which the inner portion 311*a* is formed to have a semicircular shape or U-like shape, as shown in FIG. 9.

If the material of the V-shaped bearing 111 is an electrically conductive metal, the electric current flowing in each photosensitive drum 12 can be grounded and the charging effect of the photosensitive drums 12 can be easily anticipated. If the material of the V-shaped bearing 111 is an electrically conductive synthetic resin, the electric current flowing in each photosensitive drum 12 can be grounded and the charging effect of the photosensitive drums 12 can be easily anticipated. Moreover, because insulation is also possible, the electric current can be controlled by separate grounding. When the material of the V-shaped bearing 111 is a non-conductive ceramic, insulation is possible. Therefore, the electric current can be controlled by separate grounding and the V-shaped bearing 111 itself has increased strength.

Figure 10:
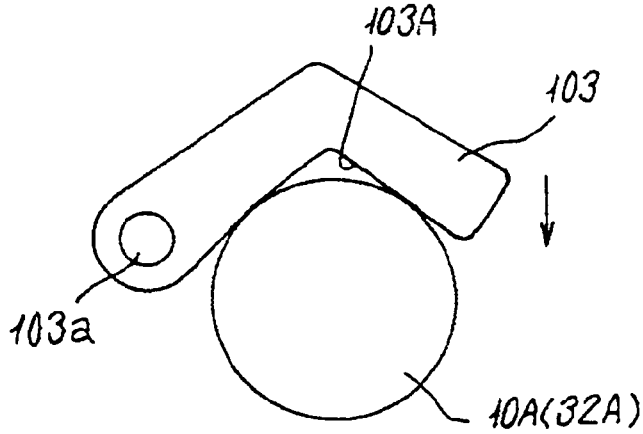
FIG. 10 is an enlarged view illustrating the relationship between another embodiment of the arm member and the shaft.
Figure 11:
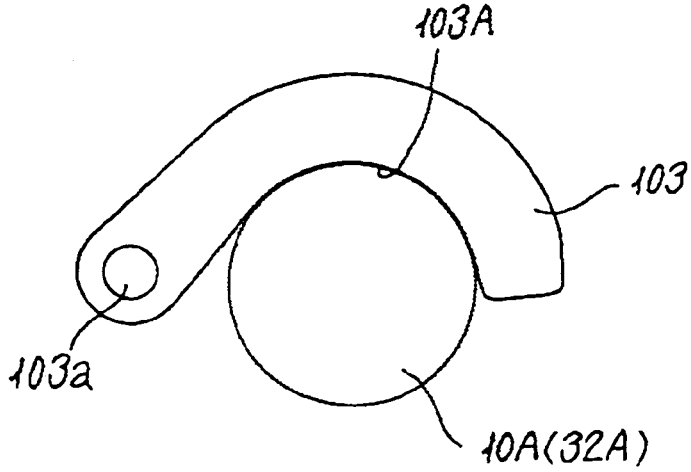
FIG. 11 is an enlarged view illustrating the relationship between another embodiment of the arm member and the shaft.
Figure 12:
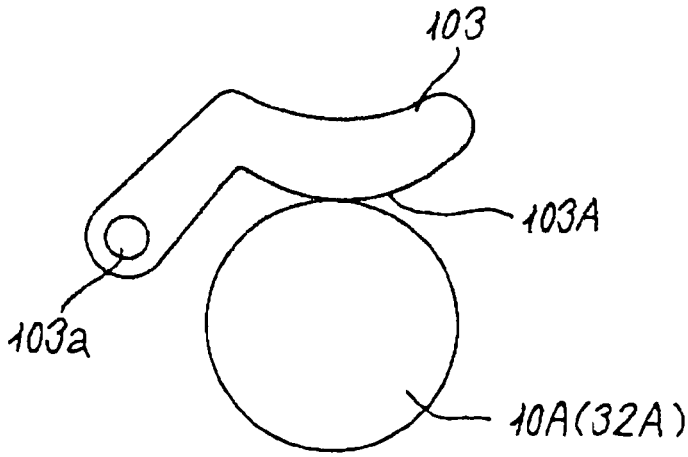
FIG. 12 is an enlarged view illustrating the relationship between another embodiment of the arm member and the shaft.

The abutment surface 103A of the arm member 103 may have a V-like shape shown in FIG. 10 or a circular arc shape shown in FIG. 11. With such shapes, a wide region of contact with each shaft 10A, 32A can be ensured and pressure can be reliably applied to each shaft. Moreover, when the drive force is transferred and each shaft is rotated, the escape of the shafts can be prevented. When the abutment surface 103A of the arm member 103 is shaped as a curved surface as shown in FIG. 12, it is in point contact or linear contact with each shaft. Therefore, the pressure application points can be concentrated and the pressure applied in a single point can be increased.

The installation mode of the V-shaped bearing 111 will be explained below.

As shown in FIG. 4 and FIG. 6, installation sections 114, 115 for inserting screws 110 as tightening members are formed on the diagonal line, with the shaft orifice as a center, in the V-shaped bearing 111 on the outer periphery thereof. The installation sections 114, 115 are disposed on the positioning plate 104 so that a straight line connecting the installation sections 114, 115 is inclined to the arrangement of the shafts 10A.

Therefore, the V-shaped bearings 111 are joined by tightening and fixed to the positioning plate 104 or side plate 200, as shown in FIG. 4, by inserting them individually into installation orifices (not shown in the figure) according to the machining accuracy of the positioning plate 104 or side plate 200 and then tightening the screws 110 (not shown in the figure) via the installation sections 114, 115 in the threaded sections formed in the positioning plate 104. Further, because joining by tightening and fixing are conducted with respect to the positioning plate 104 or side plate 200, the V-shaped bearings 111 are joined by tightening and fixed to the positioning plate 104 or side plate 200 and, therefore, can be easily replaced. Because the installation sections 114, 115 serving as the sections for installation on the positioning plate 104 assume a position inclined to the arrangement (line connecting all shafts 10A) of photosensitive drums 12, the movement range of the slide plate 108 can be ensured and good pressure application and release operations can be conducted.

The same effect can be obtained by forming the installation sections 114, 115 on the bearing members 211, 311.

With consideration for replaceability of the V-shaped bearings 111, they may be installed on the positioning plate 104 by individually inserting the bearings into installation orifices (not shown in the figures) of the positioning plate and fixing by caulking to the positioning plate 104 around the shaft orifice as a center. When fixing is thus carried out by caulking, the screws 110 are unnecessary and cost can be reduced.

The V-shaped bearings 111 are individually attached to the positioning plate 104 or side plate 200, but when, for example, the V-shaped bearings 111 supporting the shafts 10 of photosensitive drums are attached to the positioning plate 104 or side plate 200, it is also possible to provide a master jig attached to the shaft 32A of the roller 32 for regulating the row of the shafts 10A of the photosensitive drums 12 or a master jig for regulating the row of shafts 10A with reference to any of the V-shaped bearing 111 for supporting the shafts 10A and to attach the V-shaped bearings 111 to the positioning plate 104 or side plate 200 after the arrangement of the shafts 10A of the photosensitive drums has been held fixedly with the master jig. When the V-shaped bearings 111 are thus attached to the positioning plate 104 of side plate 200 after the arrangement of the shafts 10A has been held fixedly with the master jig, the installation accuracy is increased. Therefore, the accuracy between the photosensitive drums can be ensured and color shift can be fully prevented.

The arm members 103 are rotatably supported by the V-shaped bearings 111, and the abutment surface 103A thereof can have a shape shown in FIG. 7 and FIGS. 10 to 12. For example, when the abutment surface 103A of the arm member 103 applies pressure directly from above the shafts 10A, 32A, as shown in FIG. 7, the pressure application direction becomes a vertical direction with respect to the shafts 10A, 32A. Because each shaft 10A is disposed on the same line O (see FIG. 4), in this case, this direction is perpendicular to the line O. When the abutment surface 103A of the arm member 103 is in the form of a circular arc, as shown in FIG. 11, the pressure application direction is the same as the rotation direction of the shafts.

If the direction of pressure application by the arm members 103 is a vertical direction or perpendicular direction with respect to each shaft 10A, 32A, the shift of the shafts caused by the applied pressure can be prevented and the positional accuracy of the shafts can be stabilized.

The shafts 10A rotate clockwise and the shaft 32A rotates counterclockwise, as shown in FIG. 1. Therefore, when the direction of pressure application by the arm members 103 is made the same (counter direction) as the driving direction of each shaft, each shaft can be pushed efficiently and the displacement of the shafts by the driving force can be prevented. If the directions of pressure application by the arm members 103 to the shafts 10A, 32A are the same, the displacement of shafts by the driving force and applied pressure can be effectively prevented.

The arm members 103 are impelled by the torsion coil springs 108 in the direction of pressure application to the shafts 10A, 32A. Thus, the torsion coil spring 108 functions as a pressure application member for generating a pressure applied by the arm members 103. Plate springs, rubber materials, sponge materials may be also used in place of the torsion coil springs as the pressure application members.

If the applied pressure of the arm members 103 is thus generated by the torsion coil spring, a large applied pressure can be obtained within a small space. If the applied pressure of the arm members 103 is generated by the plate spring, space saving is even more than in the case where the torsion coil spring is used. If the applied pressure of the arm members 103 is generated by the elastic force of a rubber or sponge material, those materials can ensure insulating properties, if such are required.

Figure 13A:
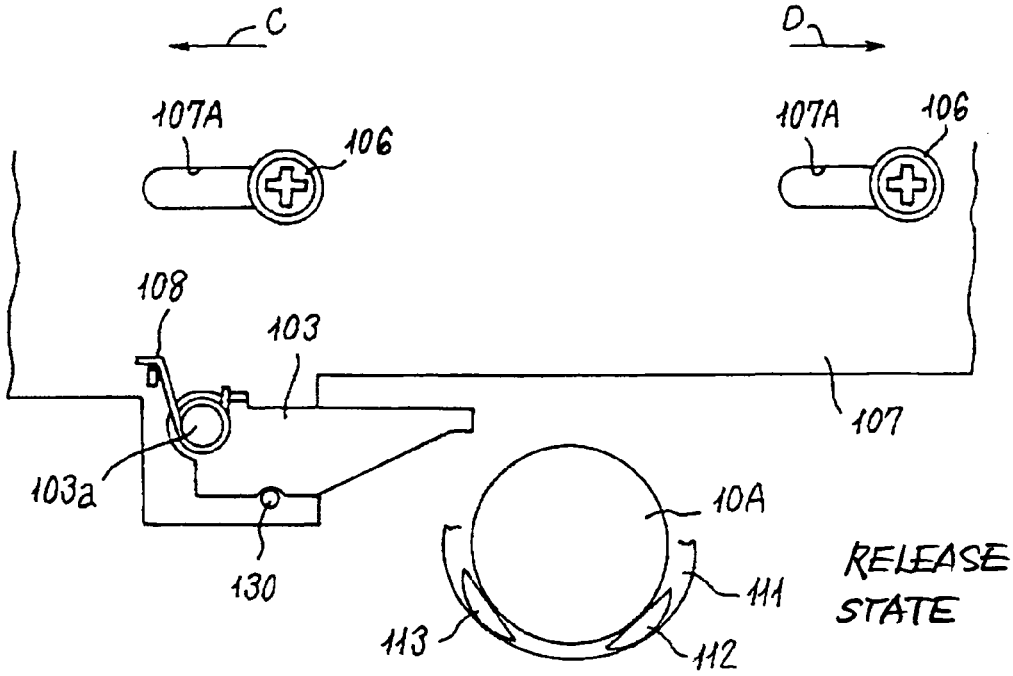
FIGS. 13A and 13B are operation diagrams illustrating the operations of pressure application to the shaft and pressure release by the arm member provided on the sliding plate.
Figure 13B:
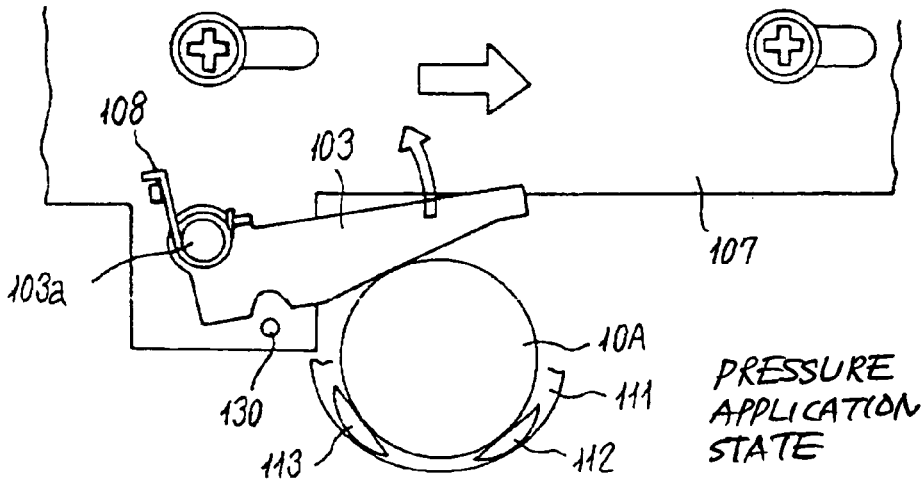

The rotation fulcrum of the arm member 103 was provided on the V-shaped bearing 111, as shown in FIG. 6, but it may be also provided, for example, in the lower part of the slide plate 107, as shown in FIGS. 13A and 13B. Thus, the arm member 103 is rotatably supported on the slide plate 107 by the support shaft 108*a* and can move integrally with the slide plate 107 above the shaft 10A. A torsion coils spring 108 is wound around the support shaft 103*a*. The two ends of the torsion coil spring 108 are locked to the slide plate 107 and arm member 107, respectively, thereby enabling the arm member 103 to move clockwise, that is, rotate in the direction of pressure application to the shaft 10A, as shown in FIGS. 13A and 13B. Therefore, the arm member 103 turns downward from the shaft 10A in a state without contact with the shaft 10A, that is, in a state with released slide plate 107. For this reason, a stopper 130 for regulating the rotation of the arm member 103 is provided on the slide plate 107.

Each arm member 103 provided on the slide plate 107 has a configuration such that it engages with the shaft 10A and applies pressure to the shaft 10A when the slide plate 107 moves in the direction of arrow D, as shown in FIG. 13A, and that the engagement with the shaft 10A is released and pressure application to the shaft is canceled if the slide plate moves in the direction of arrow C. In other words, the arm members 103 apply pressure to and release pressure from the respective shafts by moving in response to the operation of the slide plate 107.

Figure 14A:
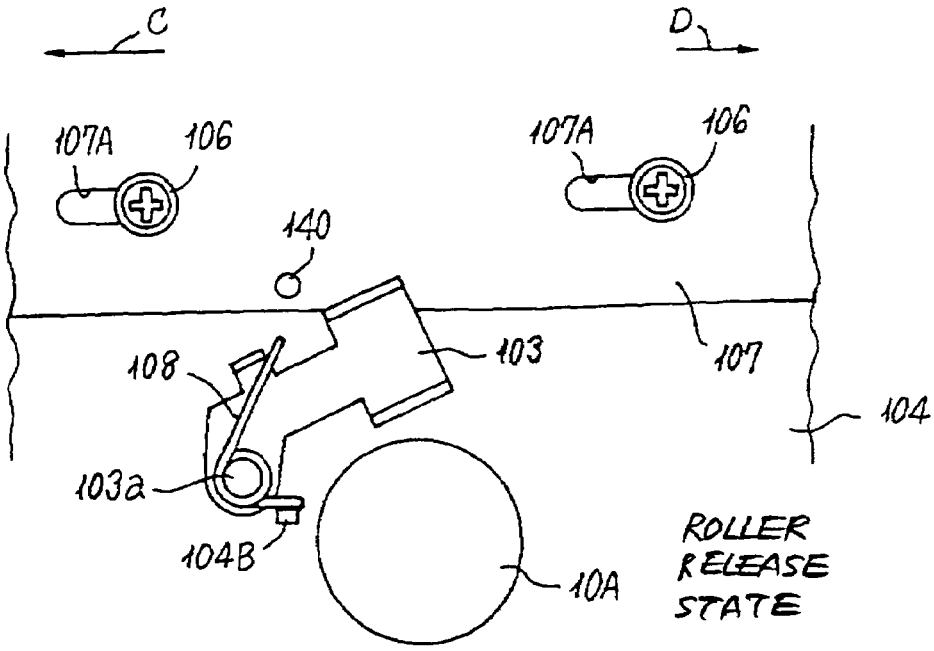
FIGS. 14A and 14B are operation diagrams illustrating the operations of pressure application to the shaft and pressure release by the arm member provided on the positioning plate.
Figure 14B:
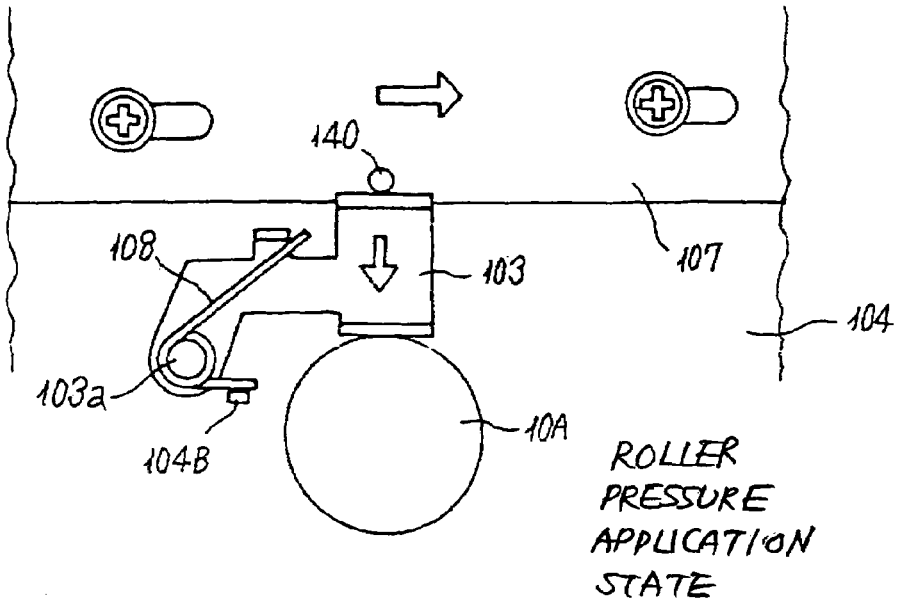

A fulcrum shaft 10 may be provided as the rotation fulcrum of the arm member 103 on the positioning plate 104, as shown in FIGS. 14A and 14B, rather than on the slide plate 107. In this case, the two ends of the torsion coil spring 108 are configured to be locked to the arm member 103 and a locking section 104*b* provided on the positioning plate 104 and to impel the arm member 103 in the direction of withdrawing from the shaft 10A. A pressure pin 140 as a pressure application member is provided in the lower part of the slide plate 107. When the slide plate 107 moves in the direction of arrow D, the pressure pin is engaged with the arm member 103 that assumed a withdrawn position and pushes the arm member and applies pressure from above to the shaft 10A via the arm member 103.

With such a configuration, if the slide plate 107 is moved in the D direction of arrow 107, the upper end of the arm member 103 that assumed a withdrawn position and the pressure pin 140 are engaged and abutted against each other, and as the slide plate 107 moves further in the D direction, the arm member 103 moves downward around the support shaft 103*a* as a center. Following this movement, the pressure pin 140 gradually applies pressure to the shaft 10A by the lower end of the arm member 103 and the highest pressure is applied to the shaft 10A when the pressure pin 140 and shaft 10A face each other. Further, the arm member 103 is held in a pressure application position by the pressure pin 140 and shaft 10A. If the slide plate 107 moves in the direction of arrow C, the position of the pressure pin 140 shifts. Therefore, pressure application to the shaft 10A is gradually released. Thus, the slide plate 107 shown in FIGS. 14A and 14B provides a function of pressure application and release to the arm members 103 that apply pressure to the respective shafts 10A. Referring to FIGS. 14A and 14B, the pressure pin 140 constitutes a pressure release mechanism for releasing the pressure applied to each shaft 10A by the movement of the sliding plate 107. Further, in the configuration shown in FIGS. 14A and 14B, the pressure application operation of the arm members 103 is carried out when the arm members 103 are fixed by the slide plate 107, the holding force of the slide member 107 can be added to the force applying pressure to the shaft 10A, and more reliable positioning can be conducted.

Figure 15:
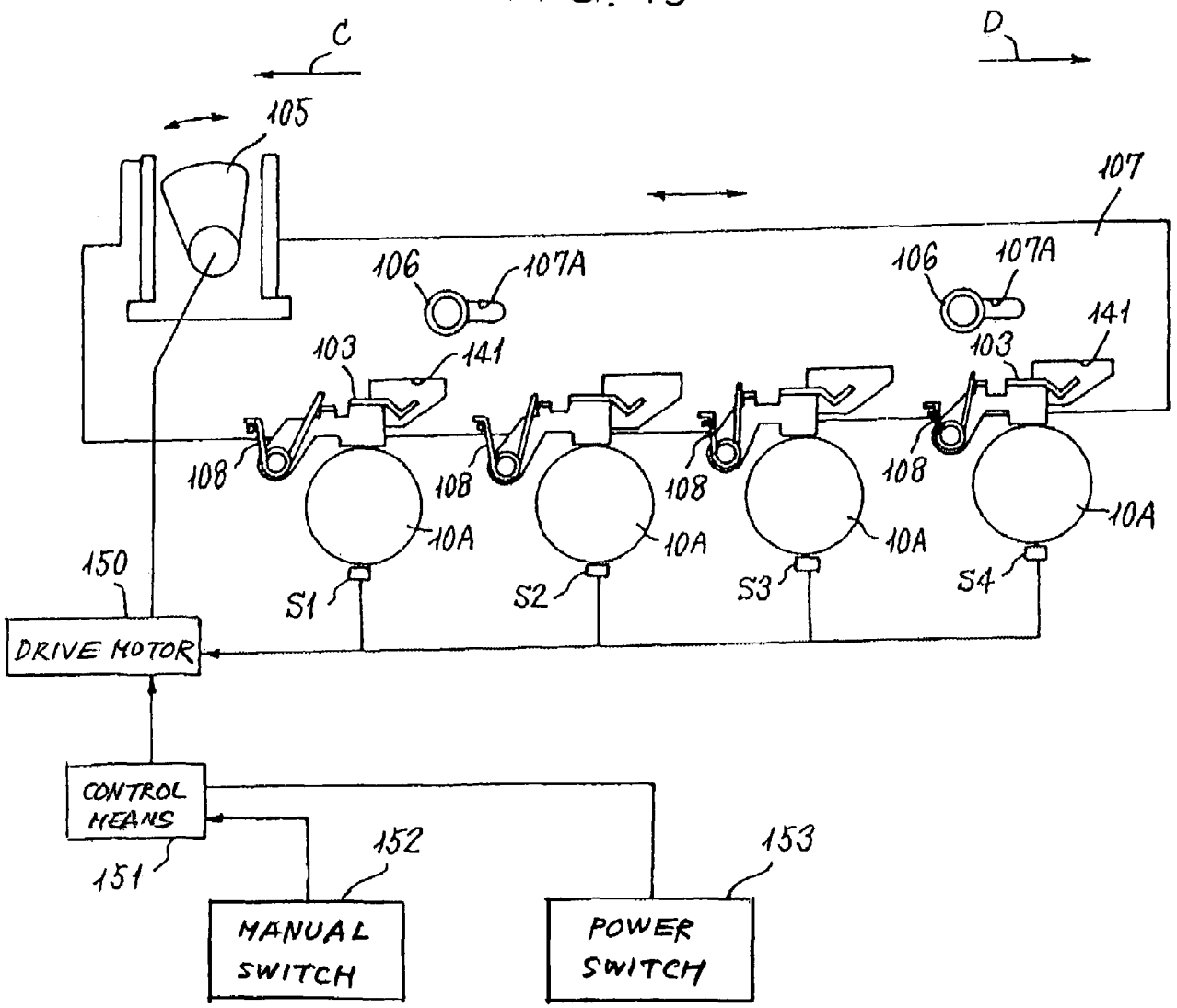
FIG. 15 illustrates the operation at the time the slide plate is moved by using a drive motor.

Referring to FIG. 15, an opening 141 is provided in place of the pressure pin 140 in the slide plate 107; this opening 141 conducts pressure application to the shaft 10A with the arm member 103 and pressure release therefrom by engaging with the free end of the arm member 103 and disengaging therefrom. In this case, the torsion coil spring 108 is installed so as to enable the arm member 103 to rotate in the direction of pressure application to the shaft 10A.

The opening 141 is provided in a position such that if the slide plate 107 moves in the direction of arrow C, the opening engages with the free end of the arm member 103, pushes the arm member up, and releases the pressure, and if the slide plate 107 moves in the direction of arrow D, the engagement of the opening with the free end of the arm member 103 is released. Therefore, if the slide plate 107 moves in the direction of arrow C, the pressure applied by the arm member 103 to the shaft 10A is released, and if the slide plate 107 moves in the direction of arrow D, the arm member applies pressure to the shaft 10A. Thus, referring to FIG. 15, the opening 141 constitutes the pressure release mechanism for releasing the pressure applied to each shaft 10A by the movement of the slide plate 107, and the pressure application operation of the arm member 103 is carried out when the free end engaged with the opening 141 formed in the slide plate 107 is released from the engagement with the opening 141. Therefore, pressure application operation by the arm member 103 is carried out without receiving the load of the slide plate 107, and the application of unnecessary load to the shafts 10A can be avoided.

As shown in FIGS. 13A, 13B, 14A, 14B, and 15, because the rotation fulcra of the arm members 103 were provided at the positioning plate 104 or slide plate 107 provided at the opening and closing face plate 100, mutual arrangement with the shafts is stable even when the opening and closing face plate 100 is opened and closed and assemblability can be improved.

Referring to FIG. 15, a motor 150 is provided as a drive source for driving the cams 105 and generating a pressure applied by the arm members 103. The cam 105 causes the slide plate 107 to move in the direction of arrows C, D by being rotationally scanned by a lever 102A shown in FIG. 2, but a strong pressure applied to the shaft 10A can be obtained by rotating the cam 105 with the drive motor 140.

Control of the drive motor 150 will be explained below with reference to FIG. 15.

Control means 151 is connected via a signal line to the drive motor 150 and the motor is driven by the control of the control means 151. For example, the positioning plate 104 is provided with sensors S1 to S4 for detecting the change in each shaft 10A, and values representing normal positions of the shafts 10A are stored in the control means 151. The control is so conducted as to drive the drive motor 150 so that the detected values from each sensor are equal to the stored values at all times. For this reason, it is preferred that a stepping motor that can be finely rotationally controlled be used for driving the drive motor 140. Driving the drive motor 150 in such a manner according to changes in the shafts 10A makes it possible to maintain the pressure applied to the shafts 10A within the appropriate range at all times.

It is also possible, for example, to provide a scale or markings serving as means for detecting the displacement amount of the shafts 10A on the positioning plate 104, instead of detecting the fluctuations of the shafts 10A with the sensors S1 to S4, and the product user or serviceman can view this means and drive the drive motor 150 according to the results obtained therewith. In this case, the drive quantity of the drive motor 150 may be controlled by providing a manually operated switch 153 on the control means 151 and manually ON/OFF switching the drive motor 150. With such a control, the force applied to the shafts 10A can be adjusted. Therefore, the correct applied force can be obtained, for example, during shipping from the plant.

Instead of setting the drive interval of the drive motor 150 in the operation interval of the manual switch 152, the control means 151 may be provided with a power source switch 153 for ON/OFF switching the power source of the image forming apparatus comprising the drive motor 150 and the drive motor 151 or sensor may be set to a standby mode and may be automatically adjusted when the machine is started by turning ON the power switch 153. In this case, the adjustment of pressure applied to each shaft is carried out each time the image forming apparatus is started or warmed up. Therefore, the apparatus can be rapidly started and a correct applied force can be obtained.

The image producing units and intermediate transfer unit 30 are the so-called maintenance objects, and at the time of replacement, they are removed from the image forming apparatus body 1 and new units are attached thereto. In such a case, too, a constant force applied to the shafts can be obtained by driving the drive motor 150 according to the shaft displacement, even if the diameter or disposition of shafts in new units are different, and the difference between the units can be absorbed.

Figure 16:
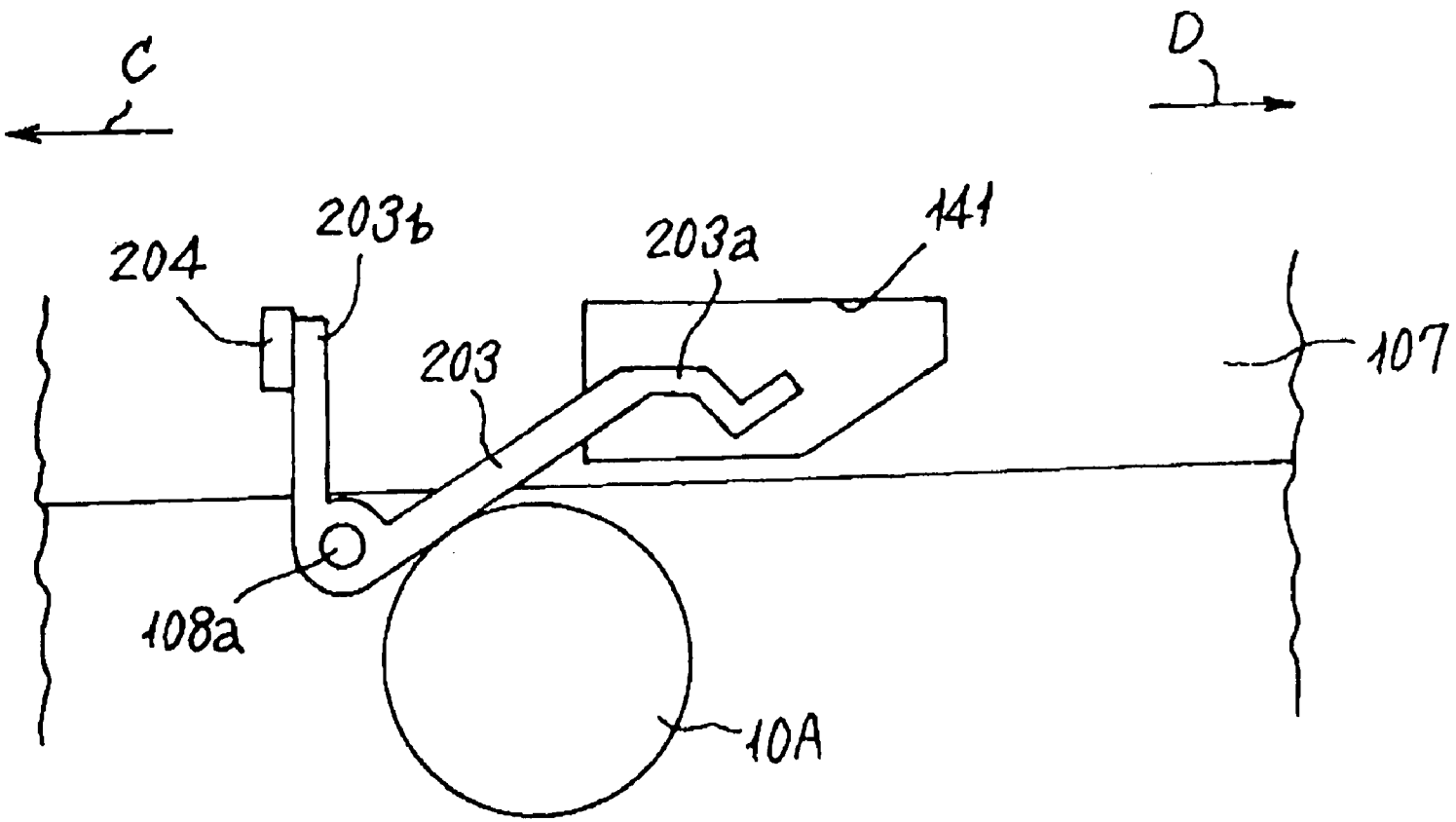
FIG. 16 is an operation diagram illustrating the operation of pressure application to the shaft by the arm member composed of an elastic member.

FIG. 16 illustrates an example in which a pressure arm 203 made from a resin is used. The pressure arm is attached with a support shaft 108 to the positioning plate 104, slide plate 107, or bearing members 111, 211, 311. In the example shown in FIG. 16, the rotation fulcrum of the pressure arm 203 formed to have a <-like shape is provided on the positioning plate 104. The slide plate 107 comprises an opening 141 for engaging with the free end 203*a* of the arm member 203 and disengaging therefrom following the movement of the slide plate 107 and a pressure application member 204 that abuts against the other end 203*b* of the arm member 203 and causes the arm member 203 to move in the pressure application direction when the slide plate 107 moves in the direction of arrow D. The opening 141 is so provided that if the slide plate 107 moves in the release direction shown by arrow C, the opening engages with the free end 203*a* and releases the applied pressure by elastically deforming the arm member in the direction of withdrawing from the shafts 10A, and if the slide plate 107 moves in the direction of arrow D, the engagement with the free end of the arm member 203 is released.

Therefore, if the slide plate 107 moves in the direction of arrow C, the arm member 203 deforms elastically, thereby releasing the pressure applied to the shafts 10A, and if the slide plate 107 moves in the direction of arrow D, a pressure is applied to the shafts 10A by the pushing force applied by the pressure application member 204. Because the arm member itself is thus made from an elastically deformable member, the inaccurate means such as the torsion coil spring 108 becomes unnecessary, the number of parts can be decreased, and the cost can be reduced.

Figure 17A:
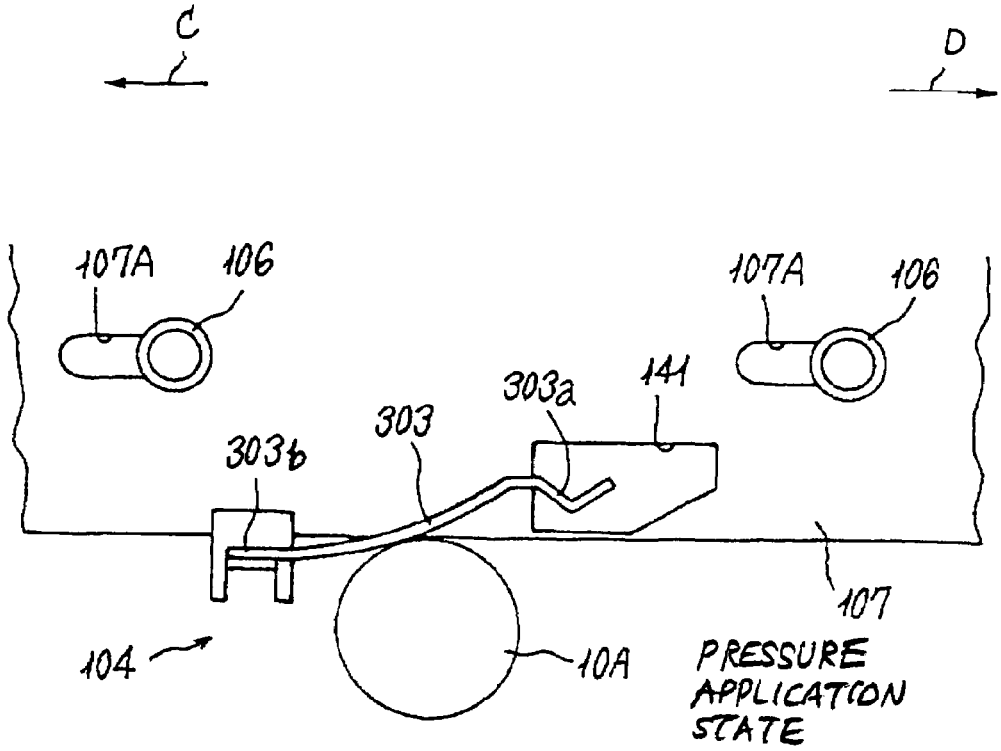
FIGS. 17A and 17B are operation diagrams illustrating the operations of pressure application to the shaft and pressure release by the arm member composed of an elastic member.
Figure 17B:
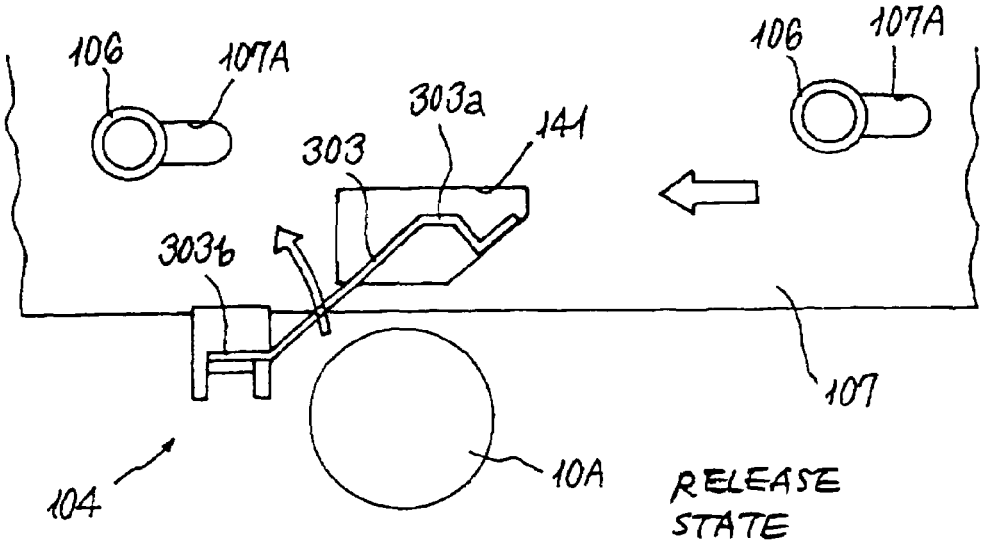

FIGS. 17A and 17B illustrate a configuration in which a base end 303*b* of the arm member 303 made from a plate spring is fixed by caulking to the lower part of the slide plate 107, and the free end 303*a* is so provided as to be engaged with the opening 141 and disengaged therefrom.

The arm member 303 is so configured that if the slide plate 107 moves in the direction of arrow C, the free end 303*a* of the arm member is pushed by the opening 303 and deformed elastically, thereby releasing the pressure applied to the shaft 10A, and if the slide plate 107 moves in the direction of arrow D, the arm member is deformed and released by its own elastic force and applies pressure to the shafts 10A. Because the arm member itself is thus made from an elastically deformable member, the pressure application means such as the torsion coil spring 108 becomes unnecessary, the number of parts can be decreased, and the cost can be reduced.

Figure 18:
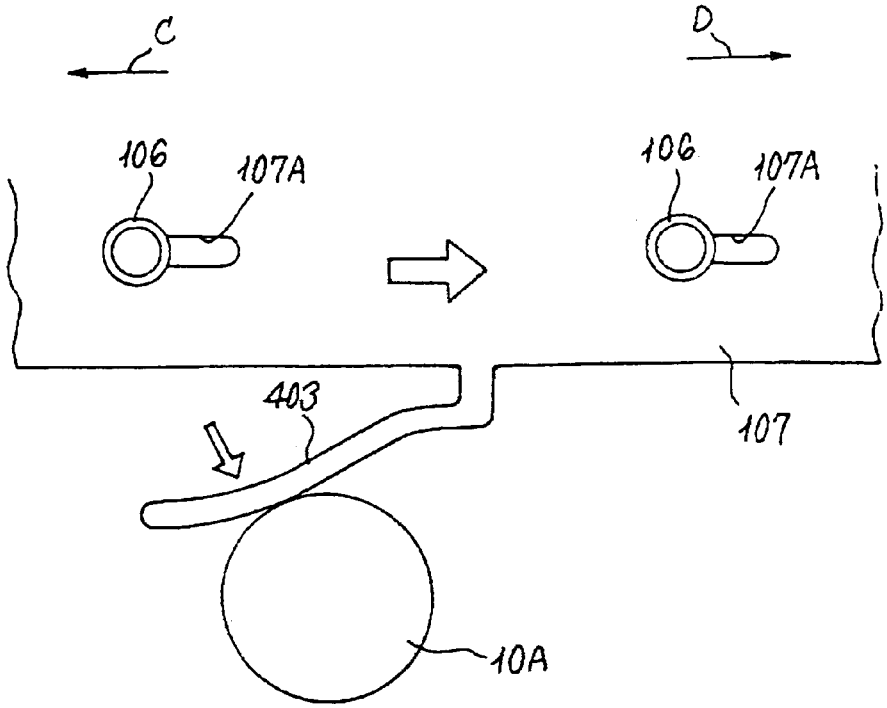
FIG. 18 is an operation diagram illustrating the operation of pressure application to the shaft by the arm member provided integrally with the slide plate.

FIG. 18 shows a configuration in which a flexible arm member 403 is formed integrally with the slide plate 107. In this case, too, if the slide plate 107 is moved in the direction of arrow C, the arm member 403 is not abutted anymore against the shaft 10A and applies no pressure to the shaft, and if the slide plate 107 is moved in the direction of arrow D, the arm member 403 can abut against the shaft 10A, deform following the movement of the slide plate 107, and apply pressure to the shafts 10A due to its flexibility.

Figure 19:
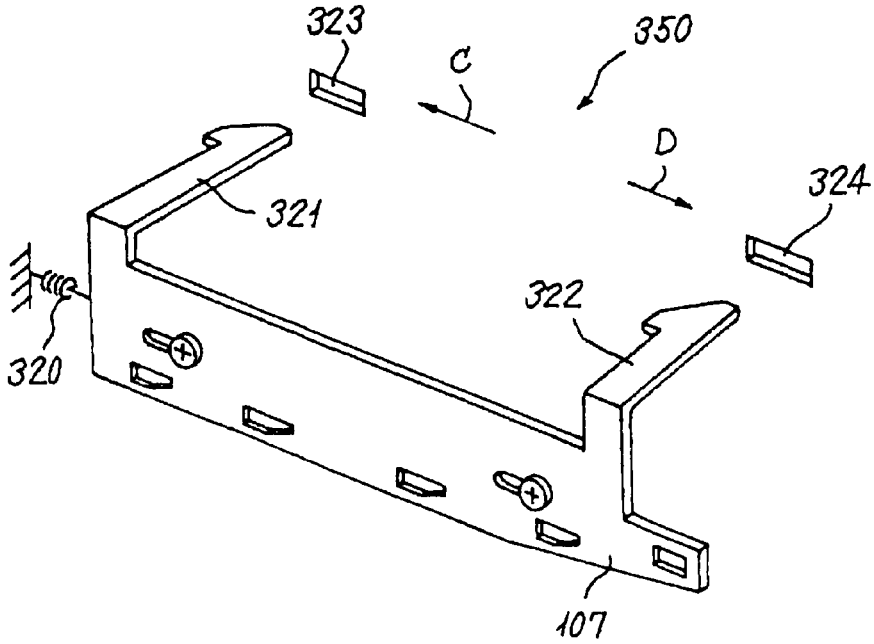
FIG. 19 is a perspective view illustrating the configuration of the locking mechanism of the slide plate.

As shown in FIG. 19, hook portions 321, 322 for engaging with the lock orifices 323, 324 formed in the image forming apparatus body 1 and disengaging therefrom are provided on the upper edge of the slide plate 107 with a spacing in the movement direction of the slide plate 107. The hook portions 321, 322 are also received in the positions of insertion into the lock orifices 323, 324 when the opening and closing face plate 100 assumes a closed position in which it closes the opening 70, as shown in FIG. 3 and FIG. 4. One end of a tension coil spring 320 serving as locking means providing the slide plate 107 with ability to move in the direction of arrow C is attached to the slide plate 107. The other end of the tension coil spring 320 is attached to the positioning plate 104 which is not shown in the figure. Thus, the lock orifices 323, 324 and hook portions 321, 322 constitute a locking mechanism 350 for regulating the movement of the slide plate 107.

Therefore, if the opening and closing face plate 100 is moved from the open position in which the opening 70 is open to the closed position and the slide plate 107 is moved in the direction of arrow D, the hook portions 321, 322 are inserted in the lock orifices 323, 324. Further, if the movement of the slide plate 107 in the direction of arrow D is then canceled, the slide plate 107 is moved under tension in the direction of arrow C by an elastic force of the tension coil spring 320, the distal ends of the hook portions 321, 322 are caught in the lock orifices 323, 324, and the opening and closing face plate 100 is held in a closed position.

In other words, the slide plate 107 is so provided that it can move in response to the operation of the locking mechanism 350 and can also move in response to the open-close operation of the opening and closing face plate 11. Furthermore, the slide plate 107 is provided with an ability to move in the direction of arrow C, and when the slide plate 107 moves in the direction of arrow C, the application of pressure to the bearings 10A, 32A by the arm members is released. Therefore, the arm members can be prevented from being caught and damaged by the shafts during opening and closing of the opening and closing face plate 100. By implementing the movement operation of the slide plate 107 that applies pressure to the arm members, which apply pressure to the shafts, and releases pressure therefrom in response to the opening and closing operation of the opening and closing face plate 100, it is possible to prevent completely the application of pressure before the opening and closing face plate 100 is opened.

The following significant effects can be obtained with the present invention.

(1) By disposing the shaft of each image carrier and the shafts of the rollers having an intermediate transfer body installed thereover on the positioning plate and applying pressure individually to each shaft, it is possible to fix the image carriers and the intermediate transfer body in normal positions, prevent color shift of the image, and improve usability.

(2) The opening and closing face plate comprising a positioning plate for supporting one end of the shaft of each image carrier and the shaft of each roller and positioning mechanisms for fixing the image carriers and the intermediate transfer body in normal positions by applying pressure independently to each shaft is provided in the vicinity of the replacement ports formed in the image forming apparatus body and used for attaching and detaching the units. Therefore, a wide opening can be provided for unit replacement, replaceability can be improved, and usability is improved.

(3) The bearing members each supporting the other end of the shaft of each image carrier and the shaft of each roller and positioning mechanisms for fixing the image carriers and the intermediate transfer body in normal positions by applying pressure independently to each shaft supported by each bearing member are disposed on the drive force connection side of each image carrier and intermediate transfer unit. Therefore, oscillations of the shaft of each image carrier and the shaft of each roller by the drive force can be inhibited and usability is improved.

(4) Because the positioning plate is provided with a bearing function of supporting the shaft of each image carrier and the shaft of each roller, the number of parts can be decreased and cost can be reduced, while improving usability.

(5) Because the V-shaped bearing for supporting the shaft of each image carrier and the shaft of each roller are provided in the opening and closing face plate for opening and closing the openings of the image forming apparatus body from below, when the face plate is closed, each shaft can be easily raised up from below and a pressure can be applied form above independently to each shaft. Therefore, each shaft is fixed by holding in the vertical direction. As a result, fixing accuracy can be increased, while improving usability.

(6) Because two ends of the rollers having the intermediate transfer body installed thereover are held by side plates manufactured with a common punching die, the production features of the orifices can be unified, the part assembling error can be reduced, and the transfer performance can be improved, while improving usability.

(7) Because two ends of each image carrier are held by side plates manufactured with a common punching die, the production features of the orifices can be unified, the intervals of colors can be unified, and color shift can be prevented, while improving usability.

(8) By using a positioning plate from a plate metal, it is possible to maintain the strength, use the positioning plate also as a grounding member for image carriers, and decrease the number of parts, while improving usability.

(9) By using a positioning plate from a metal produced by die casting, it is possible to ensure the same shape in all the sections, maintain the strength, use the positioning plate also as a grounding member for image carriers, and decrease the number of parts, while improving usability.

(10) By using the positioning plate from a resin molding, it is possible to ensure the same shape in all the sections at a low cost and prevent the leak of bias such as electrostatic charges, while improving usability.

(11) When the bearing orifices are circles, clearance fitting has to be employed with consideration for attachment and detachment, but with the configuration in which inclined surfaces producing a V-like shape or inverted V shape are formed in the bearings, or the orifices have a U-like shape or polygonal shape and the pressure is applied from above, the shafts can be held in the center of the layout and the fixing accuracy can be increased, while improving usability.

(12) If the material of the bearing is an electrically conductive metal, the electric current flowing in the image carrier can be grounded and the charging effect of the image carriers can be easily anticipated, while improving usability.

(13) If the material of the bearing is an electrically conductive synthetic resin, the electric current flowing in the image carrier can be grounded and the charging effect of the image carriers can be easily anticipated, while improving usability. Furthermore, because insulation is also possible, the electric current can be controlled by separate grounding.

(14) If the material of the bearing is a nonconductive ceramic, insulation is possible. Therefore, the electric current can be controlled by separate grounding and the bearing strength can be increased, while improving usability.

(15) Because bearing installation on the position plate is conducted by joining with machining accuracy, the accuracy can be ensured, while improving usability, and using a method of joining by tightening allows the replacement of the bearings to be easily conducted.

(16) Because bearing installation on the positioning plate is conducted by joining with machining accuracy, the accuracy can be ensured, while improving usability. Furthermore, because the bearings are installed at an angle to the shaft row of the image carriers, the movement range of the slide plate can be ensured and good pressure application and release operations are possible. Moreover, joining by tightening with screws allows the replacement of the bearings to be easily conducted.

(17) Because bearing installation on the position plate is conducted by joining with machining accuracy, the accuracy can be ensured, while improving usability. Furthermore, using caulking makes the screws 110 unnecessary and can reduce cost.

(18) Jig assembling the bearings by taking the shafts of image carriers or rollers having the intermediate transfer body installed thereover ensures transfer accuracy and accuracy among the image carriers and completely prevents color shift, while improving usability.

(19) When the surfaces of the arm members, which apply pressure to each shaft, that abut against the shafts are planes, a wide abutment region can be ensured and pressure application to each shaft can be carried out reliably, while improving usability.

(20) When the surface of each arm member that abuts against the shaft has a V-like shape or circular arc shape, a wide abutment region can be ensured, while improving usability, and the rollers can be prevented from escaping under the effect of the drive force, while reliably applying pressure to each shaft.

(21) When the surface of each arm member that abuts against the shaft is a curved surface, pressure application points can be concentrated and the pressure applied in a single point can be increased, while improving usability.

(22) By setting the direction of pressure application by the arm members, which apply pressure to the shafts, in the direction vertical with respect to each shaft, it is possible to prevent the shafts from shifting under the effect of the applied pressure, while improving usability.

(23) By setting the direction of pressure application by the arm members, which apply pressure to the shafts, in the direction perpendicular to the shaft of each image carrier, it is possible to prevent the shafts from shifting under the effect of the applied pressure, while improving usability. Furthermore, unidirectional movement of the slide plate can be ensured and good pressure application operation can be conducted.

(24) By setting the pressure applied by the arm members, which apply pressure to the shafts, in the same direction as the direction of the drive force when the positioning position differs from the drive direction, it is possible to prevent the shafts from shifting under the effect of the drive force, while improving usability.

(25) By setting the pressure applied by the arm members, which apply pressure to the shafts, in the same direction as the direction of the drive force when the positioning position is the same as the drive direction, it is possible to prevent the shafts from shifting under the effect of the drive force and applied pressure, while improving usability.

(26) The pressure application operation of the arm members, which apply pressure to the shafts, is carried out when the free end of each arm member, which is engaged with the opening formed in the slide plate, is released from the engagement with the opening. Therefore, the operation of pressure application to the arm is carried out, without receiving the load of the slide plate, while improving usability.

(27) The pressure application operation of the arm members, which apply pressure to the shafts, is carried out when the arm members are fixed by the slide plate. Therefore, the holding force of the slide plate can be added to the force of the applied pressure, while improving usability.

(28) The rotation fulcra of the arm members, which apply pressure to the shafts, are provided on the bearings for shaft fixing that are fixed to the positioning face plate. Therefore, pressure can be applied to each shaft at a low cost, while improving usability.

(29) The rotation fulcra of the arm members, which apply pressure to the shafts, are provided on the opening and closing face plate or slide plate. Therefore, assemblability can be improved, while improving usability.

(30) If the material of the arm members, which apply pressure to the shafts, is a synthetic resin, insulation can be provided when it is necessary to prevent the electrically charged members such as transfer members form being grounded, while improving usability.

(31) If the material of the arm members, which apply pressure to the shafts, is a metal, current conduction can be provided when it is necessary to ground the current, as in image carriers, while improving usability.

(32) Because the pressure applied to the arm members, which apply pressure to the shafts, is generated by a torsion coil spring, a large applied pressure can be obtained in a reduced space, while improving usability.

(33) Because the pressure applied to the arm members, which apply pressure to the shafts, is generated by a plate spring, space can be further reduced, while improving usability.

(34) Because the pressure applied to the arm members, which apply pressure to the shafts, is generated by an elastic force or a rubber or spongy material, insulating properties can be provided, when such are required, while improving usability.

(35) Because the pressure applied to the arm members, which apply pressure to the shafts, is generated by a drive force of a separate drive source, a high applied pressure can be obtained, while improving usability.

(36) By detecting shaft fluctuations and constantly adjusting the pressure applied to the arm members, which apply pressure to the shafts, according to the detected values, it is possible to obtain the correct applied pressure at all times, without selecting the conditions, while improving usability.

(37) By detecting shaft fluctuations with a jig or the like and constantly adjusting the pressure applied to the arm members, which apply pressure to the shafts, according to the detected values, it is possible to obtain the correct applied pressure at the time of shipping from the plant, while improving usability.

(38) By adjusting the pressure applied to the arm members, which apply pressure to the shafts, according to the detected values of shaft fluctuations, it is possible to start the apparatus faster and obtain more accurate applied pressure than in the case where the adjustment is conducted at all times, while improving usability.

(39) Because the shaft fluctuations are detected during shaft replacement and the pressure applied to the arm members, which apply pressure to the shafts, is adjusted according to the detected values when the apparatus is started, the correct applied pressure can be obtained, regardless of the difference between the shafts, while improving usability.

(40) Because a locking mechanism is provided on the slide plate that applies pressure to the arm members, which apply pressure to the shafts, and releases pressure therefrom, the arm members are prevented from being caught and damaged by the shafts during opening and closing of the opening and closing face plate, while improving usability.

(41) By moving the slide plate that applies pressure to the arm members, which apply pressure to the shafts, and releases pressure therefrom parallel to the shaft row of image carriers, it is possible to apply and release pressure with a simple mechanism, while improving usability.

(42) By selecting a metal as a material for the slide plate that applies pressure to the arm members, which apply pressure to the shafts, and releases pressure therefrom, it is possible to ground (conduct current from) the arm members with the slide plate.

(43) By implementing the sliding movement of the slide plate that applies pressure to the arm members, which apply pressure to the shafts, and releases pressure therefrom in response to the rotation operation of a lever, it is possible to apply and release pressure more reliably.

(44) By implementing the sliding movement of the slide plate that applies pressure to the arm members, which apply pressure to the shafts, and releases pressure therefrom in response to the opening and closing operation of the opening and closing face plate, it is possible to prevent completely the application of pressure before the opening and closing face plate is opened.

(45) Because V-shaped orifices for fixing the shafts are provided in the positioning plate, the number of parts can be decreased and positioning can be conducted at a low cost.

(46) Because pressure members for elastically applying pressure independently to each shaft are provided in the positioning plate provided with the V-shaped bearings, the applied pressure can be generated by their own elasticity, without installing special pressure generating members on the pressure members, and pressure can be applied at a low cost.

(47) Because the portions for pressure application to the arm members, which apply pressure to the shafts, are provided on the slide plate, positioning plate, and V-shaped bearings, the number of parts can be decreased and pressure can be applied at a low cost.

Various modifications will become possible for those skilled in the art after receiving the teachings of the present disclosure without departing from the scope thereof.

What is claimed is:

1. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and positioning mechanisms for disposing a shaft of each image carrier and a shaft of each roller on a positioning plate and fixing each image carrier and the intermediate transfer body in normal positions by applying pressure independently to each shaft.

2. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and an opening and closing face plate comprising a positioning plate for supporting one end of a shaft of each image carrier and a shaft of each roller and positioning mechanisms for fixing each image carrier and intermediate transfer body in normal positions by applying pressure independently to each shaft, in the vicinity of replacement ports formed in an image forming apparatus body, which has detachably attached thereto image producing units and said intermediate transfer unit, and used to attach and detach said units, wherein said opening and closing face plate is attached so as to open and close said replacement ports.

3. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and a casing comprising a positioning plate for respectively supporting an end side of a shaft of each image carrier and a shaft of each roller on a drive force connection side of each image producing unit and said intermediate transfer unit and positioning mechanisms for fixing each image carrier and the intermediate transfer body in normal positions by applying pressure independently to the shafts supported in said positioning plate.

4. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and a casing comprising bearing members for respectively supporting an end side of a shaft of each image carrier and a shaft of each roller on the drive force connection side of each image producing unit and said intermediate transfer unit and positioning mechanisms for fixing each image carrier and the intermediate transfer body in normal positions by applying pressure independently to the shafts supported by each bearing member.

5. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and an opening and closing face plate comprising a positioning plate including therein bearing members for supporting one end of a shaft of each image carrier and a shaft of each roller, positioning mechanisms for fixing each image carrier and intermediate transfer body in normal positions by applying pressure from above, independently to each shaft, and pressure release mechanisms for releasing pressure applied to each shaft by said positioning mechanisms by movement operation of a slide plate movably attached to said positioning plate, below replacement ports formed in a body of the image forming apparatus, which has detachably attached thereto the image producing units and said intermediate transfer unit, and used to attach and detach said units, wherein said opening and closing face plate is attached so as to open and close said replacement ports.

6. The image forming apparatus as claimed in claim 5, wherein bearing orifices for inserting one end of the shafts of said rollers are formed in said positioning plate, and the other end of said shafts is supported by forming orifices of the same shape as said bearing orifices with a common punching die in a side plate provided opposite said positioning plate.

7. The image forming apparatus as claimed in claim 5, wherein bearing orifices for inserting one end of the shaft of each image carrier are formed in said positioning plate, and the other end of said shaft is supported by forming orifices of the same shape as said bearing orifices with a common punching die in a side plate provided opposite said positioning plate.

8. The image forming apparatus as claimed in claim 5, wherein said positioning plate is made from a plate metal.

9. The image forming apparatus as claimed in claim 5, wherein said positioning plate is made from a metal produced by die casting.

10. The image forming apparatus as claimed in claim 5, wherein said positioning plate is made from a synthetic resin.

11. The image forming apparatus as claimed in claim 5, wherein internal faces inside of the bearing members are disposed in a V-like shape.

12. The image forming apparatus as claimed in claim 5, wherein the inside of said bearing members is formed to have a semicircular shape.

13. The image forming apparatus as claimed in claim 5, wherein the inside of said bearing members is formed to have a polygonal shape.

14. The image forming apparatus as claimed in claim 5, wherein said bearing members are made from a metal produced by die casting.

15. The image forming apparatus as claimed in claim 5, wherein said bearing members are made from a synthetic resin.

16. The image forming apparatus as claimed in claim 5, wherein said bearing members are made from a ceramic.

17. The image forming apparatus as claimed in claim 5, wherein said bearing members are installed on said positioning plate by inserting the bearing members according to the machining accuracy of the positioning plate and fixing them with tightening members.

18. The image forming apparatus as claimed in claim 5, wherein the bearing members that support the shafts of said image carriers are installed on the positioning plate by inserting the bearing members according to machining accuracy of the positioning plate, then tightening them with tightening members in two or more places around orifices of the bearing members into which said shafts are inserted, the tightening locations being arranged so that a straight line connecting said tightening locations is inclined to the arrangement of said shafts.

19. The image forming apparatus as claimed in claim 5, wherein the bearing members for supporting the shafts of said image carriers are installed on the positioning plate by inserting the bearing members according to machining accuracy of the positioning plate and fixing them by caulking to the positioning plate around orifices of the bearing members, into which said shafts are inserted.

20. The image forming apparatus as claimed in claim 5, wherein the bearing members for supporting the shafts of said image carriers are installed on the positioning plate by regulating and fixing the bearing members with a master jig for regulating the row of shafts of said image carriers with reference to the bearing members for supporting end sections of said roller.

21. The image forming apparatus as claimed in claim 5, wherein the bearing members for supporting the shafts of said image carriers are installed on the positioning plate by regulating and fixing the bearing members with a master jig for regulating the row of shafts of said image carriers with reference to the bearing member for supporting the shaft of any image carrier provided on said positioning plate.

22. The image forming apparatus as claimed in claim 5, wherein said positioning mechanism has arm members for applying pressure to respective shafts of the image carriers and shafts of said rollers and the surface of each arm member that abuts against said shaft is formed as a plane.

23. The image forming apparatus as claimed in claim 5, wherein said positioning mechanism has arm members for applying pressure to respective shafts of the image carriers and shafts of said rollers and the surface of each arm member that abuts against said shaft is formed to have a V-like shape.

24. The image forming apparatus as claimed in claim 5, wherein said positioning mechanism has arm members for applying pressure to respective shafts of the image carriers and shafts of said rollers and the surface of each arm member that abuts against said shaft is formed to have a circular arc shape.

25. The image forming apparatus as claimed in claim 5, wherein said positioning mechanism has arm members for applying pressure to respective shafts of the image carriers and shafts of said rollers and the surface of each arm member that abuts against said shaft is shaped as a curved surface.

26. The image forming apparatus as claimed in claim 5, wherein said positioning mechanism has arm members for applying pressure to respective shafts of the image carriers and shafts of said rollers and a pressure application direction of each arm member is vertical with respect to each shaft.

27. The image forming apparatus as claimed in claim 5, wherein said positioning mechanism has arm members for applying pressure to respective shafts of the image carriers and shafts of said rollers and a pressure application direction of each arm member is the direction perpendicular to a line connecting the shafts of the respective image carriers.

28. The image forming apparatus as claimed in claim 5, wherein said positioning mechanism has arm members for applying pressure to respective shafts of the image carriers and shafts of said rollers and the pressure application direction of each arm member is the same direction as the rotation directions of the respective shafts.

29. The image forming apparatus as claimed in claim 5, wherein said positioning mechanism has arm members for applying pressure to respective shafts of the image carriers and shafts of said rollers and all the pressure application directions of the arm members are the same.

30. The image forming apparatus as claimed in claim 5, wherein said positioning mechanism has arm members that move in response to the operation of a slide plate movably provided on said positioning plate and apply pressure respectively to the shaft of each image carrier and shafts of said rollers, and pressure application operation of each arm member is carrier out when the free end of each arm member that is engaged with the opening formed in said slide plate is released from the engagement with said opening.

31. The image forming apparatus as claimed in claim 5, including arm members that move in response to operation of a slide plate movably provided on said positioning plate and apply pressure respectively to the shaft of each image carrier and shafts of said rollers, wherein pressure application operation of each arm member is carrier out when each arm is fixed by said slide plate.

32. The image forming apparatus as claimed in claim 5, including arm members that move in response to operation of a slide plate movably provided on said positioning plate and apply pressure respectively to the shaft of each image carrier and shafts of said rollers, wherein the rotation fulcrum of said arm member is provided on said bearing member.

33. The image forming apparatus as claimed in claim 5, including arm members that move in response to operation of a slide plate movably provided on said positioning plate and apply pressure respectively to the shaft of each image carrier and shafts of said rollers, wherein the rotation fulcrum of said arm member is provided on said opening and closing face plate.

34. The image forming apparatus as claimed in claim 5, including arm members that move in response to operation of a slide plate movably provided on said positioning plate and apply pressure respectively to the shaft of each image carrier and shafts of said rollers, wherein the rotation fulcrum of said arm member is provided on said slide plate.

35. The image forming apparatus as claimed in claim 5, including arm members that move in response to operation of a slide plate movably provided on said positioning plate and apply pressure respectively to the shaft of each image carrier and shafts of said rollers, wherein the material of said arm members is a synthetic resin.

36. The image forming apparatus as claimed in claim 5, including arm members that move in response to operation of a slide plate movably provided on said positioning plate and apply pressure respectively to the shaft of each image carrier and shafts of said rollers, wherein the material of said arm members is a metal.

37. The image forming apparatus as claimed in claim 5, including arm members that move in response to operation of a slide plate movably provided on said positioning plate and apply pressure respectively to the shaft of each image carrier and shafts of said rollers, and torsion coil springs for generating a pressure to be applied by said arm members.

38. The image forming apparatus as claimed in claim 5, including arm members that move in response to operation of a slide plate movably provided on said positioning plate and apply pressure respectively to the shaft of each image carrier and shafts of said rollers, and plate springs for generating a pressure to be applied by said arm members.

39. The image forming apparatus as claimed in claim 5, including arm members that move in response to operation of a slide plate movably provided on said positioning plate and apply pressure respectively to the shaft of each image carrier and shafts of said rollers, and rubber or spongy materials for generating a pressure to be applied by said arm members.

40. The image forming apparatus as claimed in claim 5, including arm members that move in response to operation of a slide plate movably provided on said positioning plate and apply pressure respectively to the shaft of each image carrier and shafts of said rollers, and a drive source for generating a pressure to be applied by said arm members.

41. The image forming apparatus as claimed in claim 5, including arm members that move in response to operation of a slide plate movably provided on said positioning plate and apply pressure respectively to the shaft of each image carrier and shafts of said rollers, wherein the pressure applied by said arm members is constantly adjusted according to the fluctuation results of said shafts.

42. The image forming apparatus as claimed in claim 5, including arm members that move in response to operation of a slide plate movably provided on said positioning plate and apply pressure respectively to the shaft of each image carrier and shafts of said rollers, and detection means for detecting fluctuations of said shafts, wherein the pressure applied by said arm members is adjusted according to detection information from said detection means.

43. The image forming apparatus as claimed in claim 5, including arm members that move in response to operation of a slide plate movably provided on said positioning plate and apply pressure respectively to the shaft of each image carrier and shafts of said rollers, and detection means for detecting fluctuations of said shafts, wherein the pressure applied by said arm members is adjusted according to detection information from said detection means when the apparatus is started.

44. The image forming apparatus as claimed in claim 5, including arm members that move in response to operation of a slide plate movably provided on said positioning plate and apply pressure respectively to the shaft of each image carrier and shafts of said rollers, and detection means for detecting fluctuations of said shafts when said image carriers and/or said rollers are replaced, wherein the pressure applied by said arm members is adjusted according to detection information from said detection means when the apparatus is started.

45. The image forming apparatus as claimed in claim 5, including arm members that move in response to operation of a slide plate movably provided on said positioning plate and apply pressure respectively to the shaft of each image carrier and shafts of said rollers, and a locking mechanism for regulating the sliding of said slide plate.

46. The image forming apparatus as claimed in claim 5, including a slide plate movably provided on said positioning plate and serving to cause application and release of pressure of arm members for applying pressure respectively to the shaft of each image carrier and shafts of said rollers, wherein said slide plate is provided so as to be movable parallel to the shafts of said image carriers.

47. The image forming apparatus as claimed in claim 5, including a slide plate movably provided on said positioning plate and serving to cause application and release of pressure of arm members for applying pressure respectively to the shaft of each image carrier and shafts of said rollers, wherein said slide plate is made from metal.

48. The image forming apparatus as claimed in claim 5, including a slide plate movably provided on said positioning plate and serving to cause application and release of pressure of arm members for applying pressure respectively to the shaft of each image carrier and shafts of said rollers, and a locking mechanism for regulating the sliding of said slide plate, wherein the movement of said slide plate can be linked to the operation of said locking mechanism.

49. The image forming apparatus as claimed in claim 5, including a slide plate movably provided on said positioning plate and serving to cause application and release of pressure of arm members for applying pressure respectively to the shaft of each image carrier and shafts of said rollers, wherein the movement of said slide plate can be linked to the opening and closing operation of said opening and closing face plate.

50. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and an opening and closing face plate comprising positioning mechanisms provided on a positioning plate, which has provided therein V-shaped orifices for supporting one end of a shaft of each image carrier and a shaft of each roller, and serving to fix the image carriers and intermediate transfer body in normal positions by applying pressure independently to each shaft with a torsion coil spring, and mechanisms movably provided on said positioning plate configured to release the pressure applied to each shaft by moving a movable slide plate by a lever operation, wherein said opening and closing face plate is attached in the vicinity of replacement ports formed in a body of the image forming apparatus, which has detachably attached thereto the image producing units and said intermediate transfer unit, and used to attach and detach said units, so as to open and close said replacement ports.

51. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and an opening and closing face plate comprising positioning mechanisms comprising pressure members for elastically applying pressure independently to a shaft of each image carrier and a shaft of each roller on a positioning plate, which has provided therein V-shaped bearings for supporting one end of the shaft of each image carriers and the shaft of each roller, and serving to fix the image carriers and intermediate transfer body in normal positions, and mechanisms movably provided on said positioning plate for releasing the pressure applied to each shaft by moving a movable slide plate by a lever operation, wherein said opening and closing face plate is attached in the vicinity of replacement ports formed in a body of the image forming apparatus, which has detachably attached thereto the image producing units and said intermediate transfer unit, and used to attach and detach said units, so as to open and close said replacement ports.

52. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and an opening and closing face plate comprising a mechanism including members for applying pressure to a shaft of each image carrier and a shaft of each roller, those members being integrally provided on a slide plate movably provided on a positioning plate, which has provided therein V-shaped bearings for supporting one end of the shaft of each image carrier and the shaft of each roller, and serving to fix the image carriers and intermediate transfer body in normal positions by this applied pressure and to release the pressure applied to each shaft by moving the slide plate by a lever operation, wherein said opening and closing face plate is attached in the vicinity of replacement ports formed in a body of the image forming apparatus, which has detachably attached thereto the image producing units and said intermediate transfer unit, and used to attach and detach said units, so as to open and close said replacement ports.

53. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and an opening and closing face plate comprising a mechanism including members for applying pressure to a shaft of each image carrier and a shaft of each roller, those members being integrally provided on a positioning plate, which has provided therein V-shaped bearings for supporting one end of the shaft of each image carrier and the shaft of each roller, and serving to fix the image carriers and intermediate transfer body in normal positions by this applied pressure and to release the pressure applied to each shaft by moving a slide plate, which is movably provided on said positioning plate, by a lever operation, wherein said opening and closing face plate is attached in the vicinity of replacement ports formed in a body of the image forming apparatus, which has detachably attached thereto the image producing units and said intermediate transfer unit, and used to attach and detach said units, so as to open and close said replacement ports.

54. An image forming apparatus comprising:

a plurality of rotatable image carriers, each incorporated in a respective image producing unit;

an intermediate transfer unit comprising an intermediate transfer body which is installed between a plurality of roller members and to which transfer toner images formed on each image carrier are transferred; and an opening and closing face plate comprising a mechanism including members for applying pressure to a shaft of each image carrier and a shaft of each roller, those members being integrally provided on bearing members installed on a positioning plate for supporting one end of the shaft of each image carrier and the shaft of each roller, and serving to fix the image carriers and intermediate transfer body in normal positions by this applied pressure and to release the pressure applied to each shaft by moving a slide plate, which is movably provided on said positioning plate, by a lever operation, wherein said opening and closing face plate is attached in the vicinity of replacement ports formed in a body of the image forming apparatus, which has detachably attached thereto the image producing units and said intermediate transfer unit, and used to attach and detach said units, so as to open and close said replacement ports.

* * * * *